US005676114A

United States Patent [19]

Tarr et al.

[11] Patent Number: 5,676,114

[45] Date of Patent: Oct. 14, 1997

[54] NEEDLE CONTROLLED FUEL SYSTEM WITH CYCLIC PRESSURE GENERATION

[75] Inventors: Yul J. Tarr, Columbus; John D. Crofts, Edinburgh; John T. Carroll, III; Laszlo D. Tikk, both of Columbus, all of Ind.

[73] Assignee: Cummins Engine Company, Inc., Columbus, Ind.

[21] Appl. No.: 686,491

[22] Filed: Jul. 25, 1996

[51] Int. Cl.[6] ..... F02M 41/00; F02M 7/00

[52] U.S. Cl. ..... 123/446; 123/456

[58] Field of Search ..... 123/446, 447, 123/456, 506; 239/88, 96, 585

[56] References Cited

U.S. PATENT DOCUMENTS

| | | | |
|---|---|---|---|
| 4,069,800 | 1/1978 | Kanda et al. . | |
| 4,170,974 | 10/1979 | Kopse et al. . | |
| 4,211,202 | 7/1980 | Hafner . | |
| 4,219,154 | 8/1980 | Luscomb . | |
| 4,249,497 | 2/1981 | Eheim et al. . | |
| 4,364,360 | 12/1982 | Eheim et al. . | |
| 4,440,132 | 4/1984 | Terada et al. . | |
| 4,784,101 | 11/1988 | Iwanaga et al. . | |
| 5,094,215 | 3/1992 | Gustafson . | |
| 5,133,645 | 7/1992 | Crowley et al. . | |
| 5,176,120 | 1/1993 | Takahashi . | |
| 5,265,804 | 11/1993 | Brunel | 123/506 |
| 5,421,521 | 6/1995 | Gibson et al. . | |
| 5,441,028 | 8/1995 | Felhofer | 123/456 |
| 5,463,996 | 11/1995 | Maley et al. . | |
| 5,509,391 | 4/1996 | Degroot | 123/456 |
| 5,577,479 | 11/1996 | Popp | 123/456 |

FOREIGN PATENT DOCUMENTS

| | | |
|---|---|---|
| 2289313 | 11/1995 | United Kingdom . |
| 2291936 | 2/1996 | United Kingdom . |

OTHER PUBLICATIONS

D.H. Gibson et al., "Meeting the Customer's Needs —Defining the Next Generation Electronically Controlled Unit Injector Concept for Heavy Duty Engines," SAE Technical Paper 961285, Apr. 16–17, 1996.

*Primary Examiner*—Thomas N. Moulis

*Attorney, Agent, or Firm*—Sixbey, Friedman, Leedom & Ferguson; Charles M. Leedom, Jr.; Tim L. Brackett, Jr.

[57] ABSTRACT

The improved needle controlled common rail fuel system of the present invention includes split common rails serving respective sets of injectors and a respective high pressure pump associated with each rail. The high pressure pumps reciprocate to cyclically create gradual periods of increasing pressure in the common rail during the advancement stroke of the plunger followed by respective periods of decreasing pressure during the plunger's retraction stroke. The fuel injectors include an injection control valve and a needle control device for creating an injection event during a pumping event by controlling the fuel flow to drain so as to control the fuel pressure forces acting on an injector needle valve element. A flow limiting device is provided to limit the fuel flow from a control volume to drain during an injection event thus reducing parasitic losses while maintaining quick valve closing. The system also includes an improved fuel injector design including an intensification plunger assembly. In addition, a pressure energy recuperation means is provided which utilizes the pressure of the fuel in the common rail and the fuel injectors as a result of the pressure energy stored in the fuel to assist in retraction of the high pressure pump plunger during each pumping event. In addition, a wiring connection harness is provided which permits the connection of an electrically operated fuel delivery device, i.e. injector, to an electrical source simultaneously with the mounting of the fuel delivery device on the engine.

65 Claims, 13 Drawing Sheets

NEEDLE CONTROLLED FUEL SYSTEM WITH CYCLIC PRESSURE GENERATION

TECHNICAL FIELD

This invention relates to a fuel system for an internal combustion engine and more particularly to a fuel system for a multi-cylinder compression ignition engine capable of cyclically generating injection pressure periods to permit optimum control of injection pressure and timing.

BACKGROUND

An engine's fuel system is the component of an internal combustion engine which often has the greatest impact on performance and cost. Accordingly, fuel systems for internal combustion engines have received a significant portion of the total engineering effort expended to date on the development of the internal combustion engine. For this reason, today's engine designer has an extraordinary array of choices and possible permutations of known fuel system concepts and features. Design effort typically involves extremely complex and subtle compromises among considerations such as cost, size, reliability, performance, ease of manufacture and retrofit capability on existing engine designs.

The challenge to contemporary designers has been significantly increased by the need to respond to governmentally mandated emissions abatement standards while maintaining or improving fuel efficiency. In view of the mature nature of fuel system designs, it is extremely difficult to extract both improved engine performance and emissions abatement from further innovations in the fuel system art. Commercially competitive fuel injection systems of the future will almost certainly need to not only design new features for better achieving various objectives including improved engine performance and emissions abatement but, combine the appropriate features in the most effective manner to form a system capable of most efficiently, effectively and reliably achieving the greatest number of objectives.

Some of the most important features for achieving objectives such as improved engine performance and emissions abatement include high injection pressure capability, improved hydraulic and mechanical efficiency, quick pressure response and effective and reliable injection rate shaping capability. Other important features include drive train noise control and packaging flexibility for enabling installation on various engine configurations. U.S. Pat. No. 5,463,996 issued to Maley et al. discloses one attempt at achieving at least a few of these objectives in a fuel injection system which operates to cyclically generate high pressure fuel for predetermined periods during which an injection event may occur as controlled by a respective servo-controlled needle valve associated with each of a plurality of fuel injectors connected to a common rail. Each injector includes an intensifier assembly and a solenoid operated valve which opens to reduce the pressure in a pressure controlled volume positioned above the needle valve element, and closes to stop injection. Also, this reference discloses a hydraulic energy recirculating or recovering means for returning the energy stored in the pressurized actuating fluid to the pumping source. However, the cyclical pressure generation is created at each injector by high pressure common rail fuel acting on an injector plunger while the common rail remains at a high pressure level. As a result, each injector in this system requires a solenoid-operated control valve upstream of the intensifier assembly for initiating inward movement of the intensifier assembly, and two injection control valves for initiating pressure generation and controlling the metering and timing of an injection event, respectively, thereby adding unnecessary costs and complexity to the system. Also, this injector disclosed Maley et al. uses a relatively large dual function solenoid operator for actuating the two injection control valves, thus disadvantageously creating a large diameter injector. Moreover, the injection control valve for controlling the needle movement is reciprocated twice during each injection period to create a single injection event which ultimately increases the costs and complexity of the system. Also, this injection control valve is a three-way valve requiring more complexity in the design of the valve element and the associated flow passages than other available valve designs. In addition, the hydraulic energy recovery means disclosed in Maley et al. requires an additional control valve, a hydraulic motor and associated fuel passages resulting in an unnecessarily costly system.

SAE Technical Paper 961285 suggests a fuel system for cyclically generating periods of high pressure fuel for injection while allowing smooth pressurization and depressurization to minimize drive train torsional excitation and mechanical noise. Similar fuel injection systems are disclosed in U.K patent publications 2289313 and 2291936. These fuel systems include a cam operated plunger associated with each injector for pressurizing a storage volume of fuel for delivery to a needle cavity wherein injection is controlled by a solenoid-operated needle control valve. The paper suggests that this concept is adaptable to "mechanically actuated electronic unit injector, hydraulic electronic unit injector, electronic unit pump, and pump/line/nozzle systems." However, each of these references only discloses a mechanically actuated unit injector application comprised of unit injectors, each having a plunger actuated by a fuel injection cam. However, these systems may not be appropriate for many engine applications due to cost and packaging considerations.

U.S. Pat. No. 5,133,645 to Crowley et al. discloses a common rail fuel injection system having two common rails serving respective banks of injectors. Fuel is supplied to each rail by a respective cam-operated reciprocating plunger pump. Each injector includes a nozzle element positioned in a spring cavity which receives high pressure fuel from the common rail via a check valve. The spring cavity is also connected, via an orifice, to a pressure control volume positioned above the nozzle element. A solenoid operated control valve opens to connect the control volume to drain thereby initiating injection as fuel flows from the nozzle cavity through the orifice to drain, and closes to terminate injection. However, the common rail is maintained at a relatively constant high pressure level and therefore this system is incapable of quickly and efficiently varying the pressure in the common rail to achieve a desired corresponding injection pressure. The common rail pressure can only be slowly decreased over numerous injection events as fuel is extracted from the common rail for injection, or inefficiently decreased by spilling fuel to drain.

U.S. Pat. No. 5,176,120 to Takahashi discloses a fuel injection system including a cam-operated fuel pump for supplying high pressure fuel to a common rail serving an injector. The injector includes a needle valve movable under the influence of differential fuel pressures as controlled by a solenoid-actuated valve. The fuel pump is controlled to vary the pressure in the common rail in direct relation to the acceleration pedal depressing rate and the engine speed. The larger the acceleration pedal depressing rate or engine speed, the higher the target pressure. However, when a lower common rail pressure is desired, the common rail fuel pressure is gradually lowered by the slow incremental extraction of fuel for injection without the addition of fuel to the rail. As a result, this system is incapable of quickly varying the pressure in the common rail to achieve a desired corresponding injection pressure. Also, the servo-controlled needle valve and actuator valve assembly is unnecessarily complex. In addition, this system provides no means for recovering energy stored in the common rail.

U.S. Pat. No. 4,249,497 to Eheim et al. discloses a fuel injection system wherein fuel injection is controlled by controlling the differential pressure across a nozzle valve element using a single valve which opens to direct fuel to drain so as to start injection and closes to end injection. However, this system requires two control valves for each injector unnecessarily increasing the cost of the system. Also, this reference fails to disclose a means for achieving a broad range of fuel injection pressures, quick pressure variations and injection rate shaping.

Consequently, there is a need for a high pressure fuel system for an internal combustion engine which is capable of cyclically generating injection pressure periods and efficiently and effectively providing optimum control of fuel injection during the injection periods.

SUMMARY OF THE INVENTION

It is an object of the present invention, therefore, to overcome the disadvantages of the prior art and to provide a high pressure fuel system capable of effectively and predictably controlling fuel injection timing and metering.

It is another object of the present invention to provide a high pressure fuel injection system capable of controlling pressure independent from engine speed while cyclically providing an optimum injection pressure in the common rail for each injection event depending on operating conditions.

It is yet another object of the present invention to provide a high pressure common rail fuel system capable of cyclically increasing and decreasing the fuel pressure in the common rail to provide injection periods for selective injection by a needle control nozzle valve connected to the common rail.

It is a further object of the present invention to provide a high pressure fuel injection system capable of providing a wide range of injection pressure in the common rail available for injection from one injection event to the next.

It is a still further object of the present invention to provide a highly efficient high pressure fuel injection system capable of recuperating the pressure energy stored in the pressurized fuel in the common rail during each injection event.

Yet another object of the present invention is to provide a high pressure common rail fuel injection system which effectively utilizes plunger assemblies in each injector connected to the common rail to recuperate the pressure energy stored in the pressurized fuel during each cyclical pressure generation event.

Still another object of the present invention is to provide a high pressure fuel injection system capable of providing extremely high pressures while minimizing drive torque fluctuations in the fuel pump drive system.

A still further object of the present invention is to provide a fuel injection system capable of cyclically raising and lowering the pressure in the common rail for each injection event so as to permit responsive and efficient control of the injection pressure and timing.

Yet another object of the present invention is to provide a common rail fuel injection system which recuperates energy stored in the pressurized fuel by utilizing the plunger assemblies of a bank of injectors during each injection event.

Another object of the present invention is to provide a common rail fuel system including injectors having an intensification plunger assembly and only two fluid connection lines per injector.

It is yet another object of the present invention to provide a high pressure fuel injection system including fuel injectors having intensification plunger assemblies and the ability to monitor the individual injector performance by detecting the movement of the intensifier plunger.

It is still another object of the present invention to provide a high pressure common rail system having two common rails and respective sets of fuel injectors wherein one pressure sensor may be used to monitor the pressure in both common rails.

A still further object of the present invention is to provide a high pressure common rail fuel system wherein the fuel pressure in the rail is cyclically and gradually increased to provide pressurized injection fuel to all injectors connected to the common rail and gradually decreased to permit the injectors to transfer the unused energy in the pressurized fuel back to the engine drive system.

Another object of the present invention is to provide a common rail fuel system having two common rails and respective high pressure pumps wherein each high pressure pump includes a plunger which reciprocates through a pressurizing stroke of at least 100 crank degrees to gradually and cyclically increase and decrease the pressure in the common rails through a broad range of injection pressures.

A further object of the present invention is to provide a common rail fuel system having a split common rail with a set of injectors associated with each rail and independent fuel pressurization systems associated with each rail so as to eliminate interference between adjacent metering events and the need to shutoff all injectors in case of a failure along one rail or set of injectors.

Still another object of the present invention is to provide a high pressure fuel injection system including a plurality of injectors with needle control injection, an intensification plunger assembly and a high pressure pump assembly wherein each injector, intensification plunger assembly and high pressure pump can be packaged on the engine in a variety of locations to achieve optimum use of engine overhead space while providing efficient and effective fuel injection.

Yet another object of the present invention is to provide a novel high pressure common rail fuel injection system capable of synergistically creating high pressure capability, quick pressure response, high pumping efficiency, injection pressure flexibility and decreased drive train noise.

A still further object of the present invention is to provide a simple, low cost high pressure unit injector including a hydraulic controlled needle valve, an actuator for controlling the hydraulic flow so as to control injection and a pump control valve for initiating a pressure generation event wherein the injection actuator valve and the pump control valve are optimally positioned and controlled to simplify the injector design while ensuring optimum and effective control of injection.

It is still a further object of the present invention to provide a needle controlled fuel injector which minimizes the quantity of fuel flowing to a low pressure drain during each injection event.

Another object of the present invention is to provide a common rail fuel injection system which integrates the common rail supply volume into the fuel chambers and passages in the fuel injectors.

Yet another object of the present invention is to provide a fuel injection system including an air purge circuit for permitting simple, effective removal of air/gas from the injection fuel passages including the fuel transfer circuit and nozzle cavity of the injectors.

It is yet another object of the present invention to provide a wiring connection harness for electrically connecting electrically operated devices associated with a fuel injector or pump assembly, such as an injection control valve or plunger position sensing device to an electrical source by simply mounting the injector or pump assembly onto the cylinder head of an engine without further connection steps.

Still another object of the present invention is to provide a wiring connection harness which permits the connection of an electrically operated fuel delivery device to an electrical source simultaneously with the mounting of the fuel delivery device on an engine.

Another object of the present invention is to provide a method of electrically connecting a fuel injector to an electrical source with a minimum number of mounting and connection steps.

These and other objects are achieved by providing a fuel injection system for controlling fuel injection into combustion chambers of a multicylinder internal combustion engine, comprising a fuel supply device including a low pressure fuel supply for supplying fuel at a low supply pressure and a first common rail fluidically connectable to the low pressure fuel supply. The system also includes a first high pressure pump for receiving low pressure supply fuel from the low pressure fuel supply and cyclically increasing and decreasing the fuel pressure in the common rail to create sequential pumping events. Each of the pumping events include a period of increasing fuel pressure followed by a period of decreasing fuel pressure. The common rail is fluidically connected to the low pressure fuel supply between the pumping events. The fuel injection system also includes a first set of fuel injectors connected to the first common rail for receiving fuel from the first common rail and for injecting fuel at high pressure into respective combustion chambers of the engine. The system may also include a second common rail connected to the low pressure fuel supply and a second high pressure pump for cyclically increasing and decreasing the fuel pressure in the second common rail to create sequential pumping events alternating with the pumping events of the first common rail and first high pressure pump. The second common rail is also fluidically connected to the low pressure fuel supply between the pumping events. A second set of injectors is connected to the second common rail for injecting fuel into respective combustion chambers. Each injector of the first and second set of injectors may include an injector body containing an injector cavity, a fuel transfer circuit, an injection orifice and a plunger reciprocably mounted in the injector cavity. Each plunger associated with each injector may reciprocate during each of the pumping events in response to increasing and decreasing fuel pressure so that all injector plungers associated with a given common rail reciprocate during each pumping event by the high pressure pump associated with that common rail. Each high pressure pump includes a pump plunger mounted for reciprocal movement and a pump chamber formed adjacent one end of the pump plunger. The pump chamber of each high pressure pump is in continuous fluidic communication with the respective common rail and the fuel transfer circuit of each of the injectors in the associated rail during each of the pumping events. As a result, the present system includes a pressure energy recuperation means for utilizing the pressure of the fuel in the common rail as a result of the energy stored in the fuel due to the elastic compressibility of the fuel to assist in retraction of the high pressure pump plunger during each pumping event.

Each injector may also include an actuating chamber formed between the plunger and the common rail and a high pressure chamber formed in the injector cavity between the plunger and the injection orifice. Each of the actuating chambers fluidically communicate with the respective common rail during each of the pumping events. This design forms another part of the pressure energy recuperation means which utilizes the pressure of the fuel in the high pressure chamber of each injector to assist in retraction of the high pressure pump plunger during each pumping event.

Each of the injectors may include a fuel pressure intensification assembly/module for pressurizing injection fuel including an actuating plunger and high pressure plunger reciprocally mounted in the injector cavity between the actuating chamber and the high pressure chamber. The actuating plunger includes an actuating plunger cross sectional area exposed to the fuel in the actuating chamber while the high pressure plunger includes a high pressure plunger cross sectional area exposed to fuel in the high pressure chamber. The actuating plunger cross sectional area is greater than the high pressure plunger cross sectional area causing the pressure of the fuel in the common rail to move the actuating plunger during a pumping event for pressurizing fuel in the high pressure chamber to a pressure level greater than the pressure in the common rail and actuating chamber. The fuel transfer circuit may include a delivery passage formed in the actuating plunger and the high pressure plunger for delivering fuel from the actuating chamber to the high pressure chamber. Each injector may also include a plunger position sensing means, i.e. a linear variable differential transformer, mounted in the injector cavity for detecting displacement of one of the injector plungers.

Each high pressure pump may also include a pump control valve for controlling the effective displacement of the pump plunger. Each pump control valve may include a pump control valve element which extends into the pump chamber. In addition, a pump housing may be provided to contain both the first and second high pressure pump and a cam for reciprocating the pump plungers. The pumps may be positioned in the housing on opposite sides of the cam for reciprocating the high pressure pump plungers along a common axis. The cam may be an eccentric cam including a sliding bearing sleeve positioned between the cam and the pump plunger.

Each injector body may include an injector retainer forming a retainer cavity, a nozzle module mounted in the retainer cavity including an inner nozzle housing and a one-piece outer nozzle housing positioned in abutment with the inner nozzle housing. Each injector body may also include an injection actuator module positioned in abutment with the outer nozzle housing for supporting an injection control valve. This design creates less than four high pressure joints spaced axially along the injector between the injection control valve and the injection orifice for containing fuel in the fuel transfer circuit. In one embodiment, each injector includes only two high pressure joints between the injection control valve and the injection orifice: one formed between the inner nozzle housing and the outer nozzle housing and a second formed between the outer nozzle housing and the actuator module.

Each injector of the first and second sets of fuel injectors may also include a closed nozzle assembly including a needle valve element reciprocably mounted for movement between a close position blocking fuel flow through the injection orifice and an open position permitting fuel flow through the injection orifice. Each injector may also include a needle valve control device for moving the needle valve element between the open and close positions. The needle valve control device may include a control volume positioned adjacent an outer end of the needle valve element, a drain circuit for draining fuel from the control volume to a low pressure drain, and the injection control valve positioned along the drain circuit for controlling the flow of fuel through the drain circuit so as to cause the movement of the needle valve element between the open and closed positions. The needle valve control means may further include a control volume charge circuit for supplying fuel from the fuel transfer circuit to the control volume. Each injector may further include a flow limiting device for limiting the fuel flow from the control volume to the low pressure drain when the needle valve element is in the open position. The flow limiting device may include a control volume inlet port fluidically connecting the charge circuit and the control volume, a control volume outlet port fluidically connecting the control volume and the drain circuit and a flow limiting valve formed on the outer end of the needle valve element for at least partially blocking the control volume inlet port and the control volume outlet port to limit fuel flow to the low pressure drain.

The system may also include a sensing passage connecting the first and second common rails and a pressure sensor positioned along the sensing passage for sensing pressure in both the first and second common rails.

The present invention is also directed to a unit fuel injector for receiving low pressure fuel from a fuel supply and injecting the fuel at a high pressure into a combustion chamber of an engine, comprising an injector body containing an injector cavity, a fuel transfer circuit and an injection orifice formed in one end of the injector body, a plunger reciprocally mounted in the injector cavity and a high pressure chamber formed between the plunger and the injection orifice. The plunger is movable into the high pressure chamber to increase the pressure of the fuel in the chamber. The injector also includes a close nozzle assembly including a valve element movable between open and close positions and a needle valve control device for moving the needle valve element between its positions. The needle valve control device may include a control volume positioned at one end of the needle valve element, a control volume charge circuit for supplying fuel from the fuel transfer circuit, a drain circuit for draining fuel from the control volume to a low pressure drain, and an injection control valve positioned along the drain circuit for controlling the flow of fuel through the drain circuit so as to cause movement of the needle valve element. The injection control valve is a two-way, solenoid operated valve movable into a closed position to block fuel flow from the control volume and into an open position to permit fuel flow from the control volume charge circuit into the control volume and from the control volume to the low pressure drain. The control volume charge circuit may include a first end opening directly into the needle cavity formed in the injector body for housing the needle valve element. The solenoid operated injection control valve may include a coil assembly positioned along the injector body between the high pressure chamber and the control volume. The injector may further include a solenoid operated pressure control valve for controlling the flow of fuel between the high pressure chamber and the fuel supply. The pressure control valve also includes a coil assembly mounted in the injector body a spaced distance from the injection control solenoid coil assembly.

The present invention is also directed to a wiring connection harness for electrically connecting one or more electrically operated devices, coupled to a fuel delivery device mounted in a mounting bore formed in an engine, to an electrical source, comprising a harness body including a conductive element, an insulating jacket covering at least a portion of the conductive element, a first connector for connection to the electrically operated device. The harness body is fixedly attached to the engine in a fixed, predetermined position relative to the fuel delivery apparatus mounting bore. Movement of the fuel delivery apparatus into the mounting bore simultaneously connects the electrically operated device of the fuel delivery apparatus to the first connector. The fuel delivery apparatus may be a fuel injector and the electrically operated device may be a solenoid-operated fuel flow control valve. The harness body may include a second connector for engagement by a displacement sensor connector mounted on an intensification plunger assembly for providing an electrical connection to an intensification plunger displacement sensor mounted on the pump assembly. The invention is also directed to a fuel delivery device including a wiring connection harness mounted on the engine adjacent the injector mounting bore in a fixed predetermined position. The injector mounting bore may be formed in a cylinder head of an engine and a fuel passage formed in the cylinder head so as to open into the mounting bore. Thus, the present invention is also directed to a method of mounting a fuel delivery device including an electrically operated device to an engine, comprising the steps of providing a fuel delivery device, a respective mounting bore and a wiring connection harness, mounting the wiring connection harness on the engine adjacent the mounting bore in a fixed predetermined position relative to the mounting bore, and inserting the fuel delivery device into the mounting bore. The insertion of the fuel delivery device into the bore toward a mounted position simultaneously causes the electrical connector of the electrically operated device to engage the electrical harness connector so as to form a secure electrical connection when the fuel delivery device is positioned in the mounted position.

DETAILED DESCRIPTION OF THE PREFERRED EMBODIMENT

Throughout this application, the words "inward", "innermost", "outward" and "outermost" will correspond to the directions, respectively, toward and away from the point at which fuel from an injector is actually injected into the combustion chamber of an engine. The words "upper" and "lower" will refer to the portions of the injector assembly which are, respectively, farthest away and closest to the engine cylinder when the injector is operatively mounted on the engine.

Figure 1:
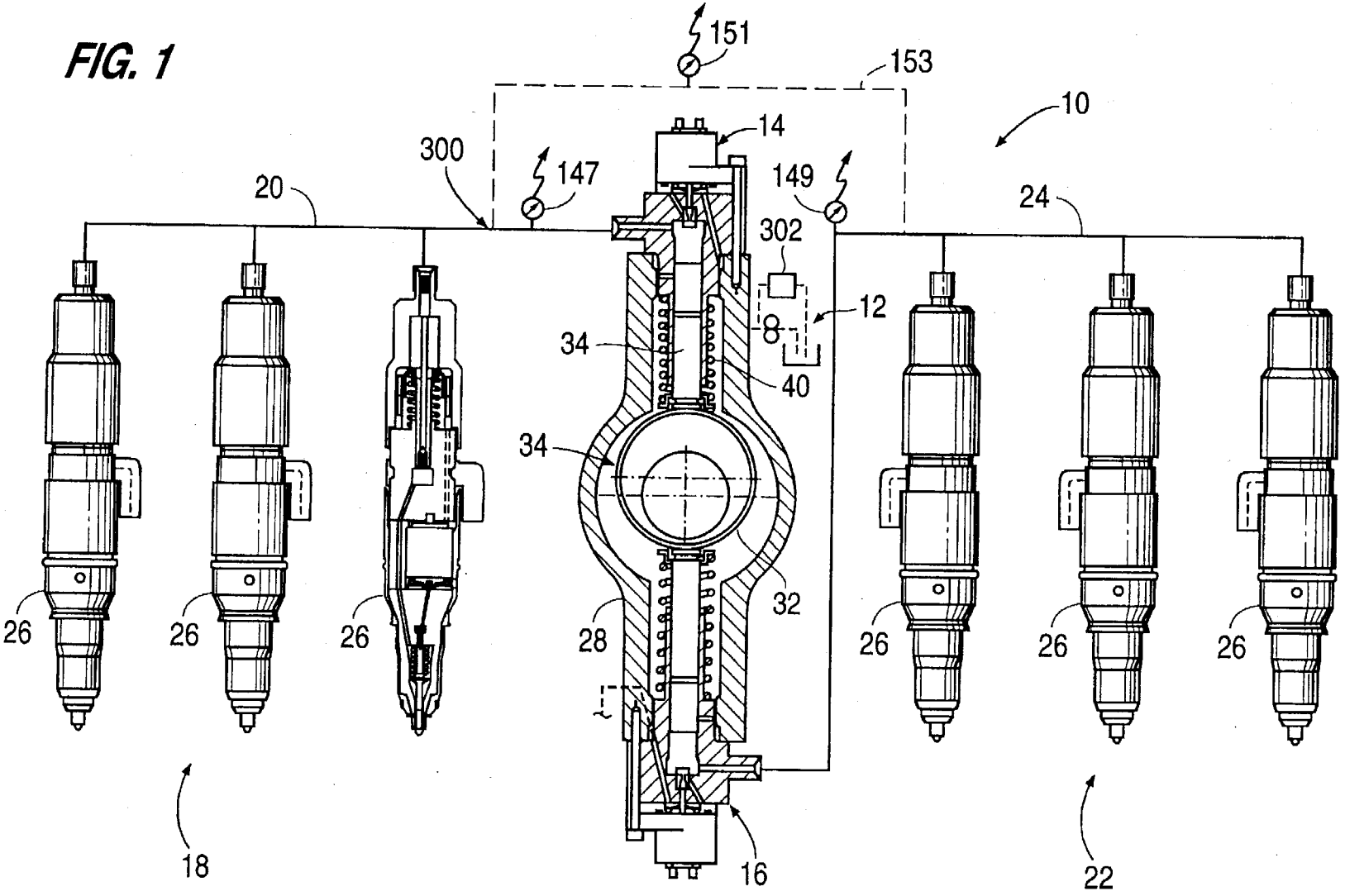
FIG. 1 is a schematic view of the preferred embodiment of the needle controlled common rail fuel system of the present invention.

Referring to FIG. 1, there is shown a needle controlled, common rail fuel system 10 of the present invention as applied to a six-cylinder engine (not shown) having one injector associated with each cylinder. Generally, the fuel system 10 includes a low pressure fuel supply 12 for supplying low pressure fuel to both a first high pressure pump 14 and a second high pressure pump 16. First high pressure pump 14 cyclically delivers high pressure fuel to a respective first set of injectors 18 via a first common rail 20. Second high pressure pump 16 also cyclically delivers high pressure fuel to a respective second set of fuel injectors 22 via a second common rail 24. Each set of fuel injectors 18, 22 includes a fuel injector 26 operable to inject fuel into a respective engine cylinder to define an injection event during a pumping event created by the associated high pressure pump. As discussed in detail hereinbelow, this system uses cyclic pressure generation principles to cyclically and gradually increase and decrease the fuel pressure in first and second common rails 20, 24 advantageously resulting in a greater range of available injection pressures for each injection event while minimizing drive torque fluctuations. Moreover, the present system maximizes efficiency by recuperating the pressure energy in the high pressure fuel present in the common rail and fuel injectors during each pumping event by the high pressure pumps 14, 16 while also minimizing both the trapped volume and parasitic losses due to fuel drain flow. Thus, the present system possesses many of the flexibilities of a traditional common rail system while permitting the selection of a greater range of fuel pressures for each injection event.

Figure 2:
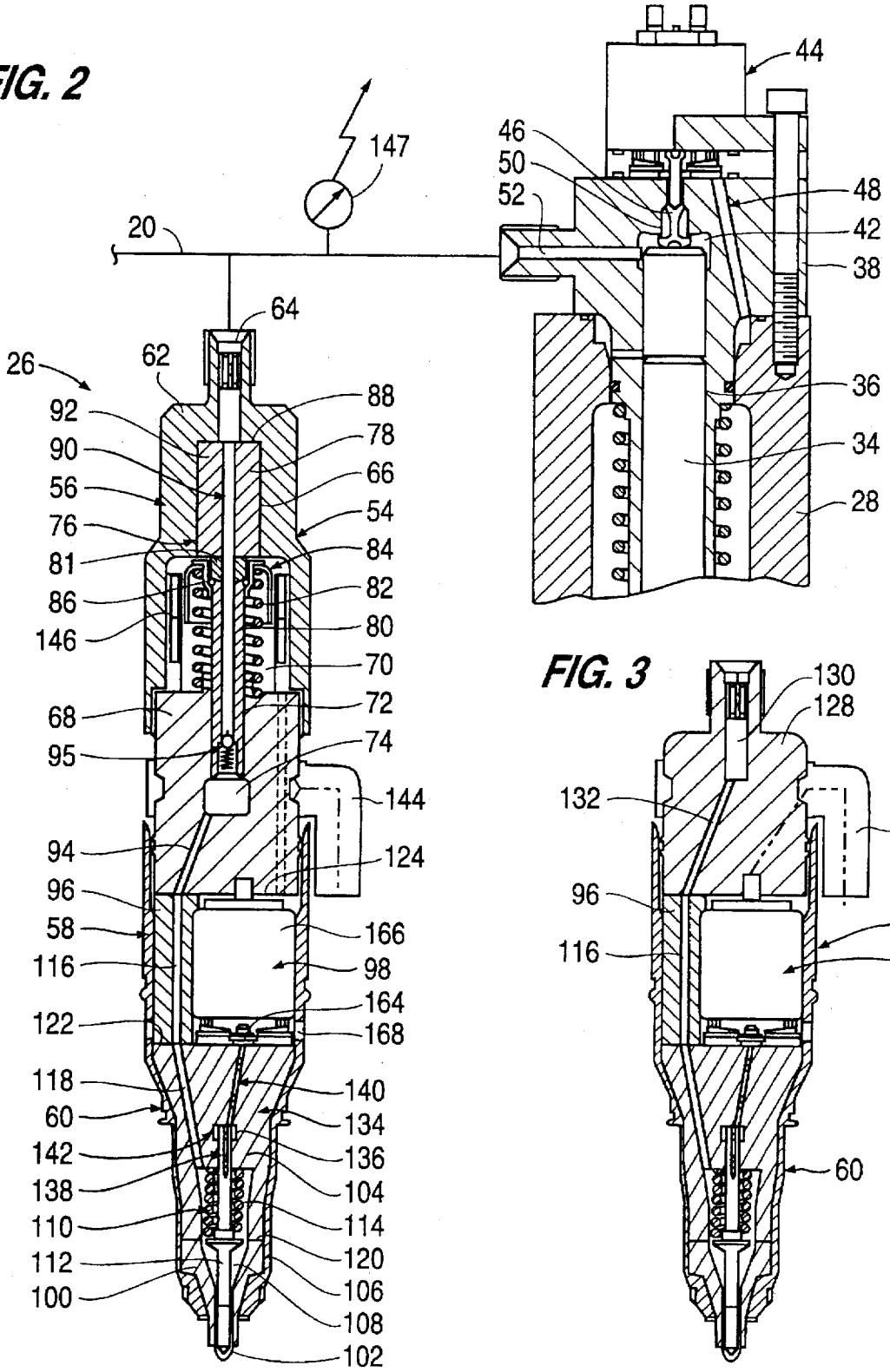
FIG. 2 is a cross-sectional view of a closed nozzle injector and partial cross-sectional view of the high pressure pump used in the needle controlled common rail fuel system of FIG. 1.

As shown in FIG. 1, first and second high pressure pumps 14, 16 may be mounted in a common pump housing 28 and positioned opposite one another on either side of a cam 30. Cam 30 may be of the eccentric type having a sliding bearing sleeve 32. It should be noted that the high pressure pumps may be arranged in an in-line, or side-by-side, manner wherein each is served by a respective cam. Each high pressure pump is substantially the same in structure and therefore the components of the pumps will be described with respect to first high pressure pump 14 only. Second high pressure pump 16 only differs from first high pressure pump 14 in that it is associated with second common rail 24 which is fluidically separate from first common rail 20. As shown in FIGS. 1 and 2, first high pressure pump 14 includes a pump plunger 34 positioned in a plunger bore 36 formed in a plunger barrel 38 mounted on the top of housing 28. A coil spring 40 biases plunger 34 into abutment with sliding bearing sleeve 32. As cam 30 rotates, the cam causes pump plunger 34 to reciprocate 180° out of phase with the reciprocation of the pump plunger associated with second high pressure pump 16. A tappet may be provided around the inner end of plunger 34 for slidable engagement with the inner walls of housing 28 to minimize side loading on plunger 34. First high pressure pump 14 also includes a pump chamber 42 formed between the inner end of plunger bore 36 and pump plunger 34 for receiving low pressure fuel from fuel supply 12. High pressure pump 14 further includes a pump control valve 44 mounted on the top of pump barrel 38 and including a pump control valve element 46 extending into pump chamber 42. A low pressure fuel supply circuit 48 formed in pump barrel 38 and pump control valve 44 delivers low pressure fuel to pump chamber 42 via a valve port 50. Pump control valve 44 may be a solenoid operated two-way valve whereby energization of the solenoid moves control valve element 46 into a closed position blocking flow from pump chamber 42 through valve port 50 and de-energization permits movement of control valve element 46 into an open position causing flow between pump chamber 42 and low pressure fuel supply circuit 48. The actuator for pump control valve 44 may alternatively be of the piezoelectric or magnetostrictive type. An outlet passage 52 formed in barrel 38 fluidically connects pump chamber 42 to first common rail 20.

Referring to FIG. 2, each fuel injector 26 includes an injector body 54 comprised of a pressure intensifier assembly or module 56, an actuator module 58 and a nozzle module or assembly 60. Intensifier module 56 includes an outer housing 62 having an inlet passage 64 connected at one end to first common rail 20 and at an opposite end to a plunger cavity 66 formed in housing 62. Fuel intensifier module 56 also includes an inner housing 68 threadably connected to outer housing 62 to form a larger cavity 70. Inner housing 68 includes a plunger bore 72 extending inwardly through housing 68 to connect with a high pressure chamber 74. Intensifier module 56 further includes an intensification plunger assembly 76 including an actuating plunger 78 positioned for reciprocal movement in plunger cavity 66, a high pressure plunger 80 mounted for reciprocal movement in plunger bore 72 and extending outwardly into larger cavity 70, and a link 81 positioned in sealing abutting relationship between the inner end of actuating plunger 78 and the outer end of high pressure plunger 80. A coil spring 82 biases high pressure plunger 80 outwardly into abutment with link 81. The abutting joint between link 81 and high pressure plunger 80 may be curved or spherical in shape to permit proper aligned mating of the ends of link 81 and plunger 80 regardless of alignment tolerance differences between plunger cavity 66 and plunger bore 72. One end of coil spring 82 seats against the outer end of inner housing 68 while the opposite end abuts a spring seat device 84 connected to the outer end of high pressure plunger 80 by a snap ring 86. An actuating chamber 88 is formed in module 56 between actuating plunger 78 and the inner end of plunger cavity 66. Each injector 26 includes a fuel transfer circuit 90 for transferring fuel from first common rail 20 to nozzle module 60. Fuel transfer circuit 90 includes inlet passage 64 and a delivery passage 92 extending axially through actuating plunger 78 and high pressure plunger 80 to connect actuating chamber 88 to high pressure chamber 74. Fuel transfer circuit 90 also includes a passage 94 extending from pressure chamber 74 through inner housing 68 for delivering high pressure fuel to nozzle module 60 via actuator module 58. A spring bias check valve 95 mounted in high pressure plunger 80 along delivery passage 92, functions to block the flow of fuel from high pressure chamber 74 into delivery passage 92 while permitting fuel flow through delivery passage 92 into high pressure chamber 74 after the fuel in actuating chamber 88 has reached a minimum predetermined pressure corresponding to the bias force of the spring used in the check valve.

Injection actuator module 58 includes a spacer 96 and an injection control valve 98 for creating an injection event. Nozzle module 60 includes an inner nozzle housing 100 having injection orifices 102 and a one-piece outer nozzle housing 104 positioned between inner nozzle housing 100 and spacer 96. Injector body 54 further includes an injector retainer 106 within which spacer 96, outer nozzle housing 104 and inner nozzle housing 100 are held in a compressive abutting relationship. The outer end of retainer 106 contains internal threads for engaging external threads on the inner end of inner housing 68 to permit the fuel intensifier module 56 to be connected to actuator module 58 and nozzle module 60 by simple relative rotation of retainer 106 with respect to inner housing 68. One-piece outer nozzle housing 104 and inner nozzle housing 100 include facing cavities which form a needle cavity 108 for receiving a closed nozzle valve assembly 110 including a needle valve element 112 and a bias spring 114. Fuel transfer circuit 90 further includes a passage 116 communicating at one end with passage 94 and extending through spacer 96. Transfer circuit 90 also includes a passage 118 communicating at one end with passage 116 and extending through outer nozzle housing 104 to communicate with needle cavity 108. It should be noted that this combination of injector components is designed to minimize the number of high pressure joints exposed to high pressure fuel thus reducing the cost of the injector and the amount of fuel leakage. A first high pressure joint 120 is formed between inner nozzle housing 100 and one-piece outer nozzle housing 104. A second high pressure joint 122 is formed between outer nozzle housing 104 and its abutment with actuator module 58. Also, a third high pressure joint 124 is formed between actuator module 58 and inner housing 68. Thus, this design limits the number of high pressure joints to only three thereby creating a simple, low cost injector which minimizes fuel leakage and thus is more likely to ensure efficient delivery of high pressure fuel during each injection event.

Figure 3:
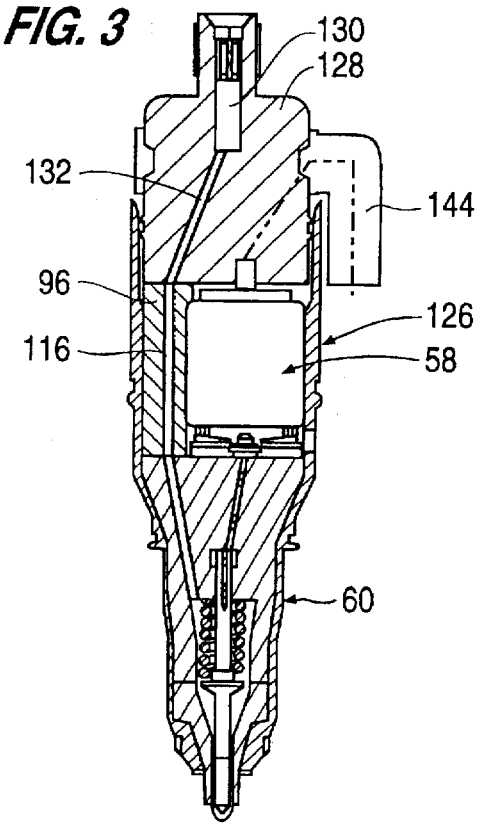
FIG. 3 is a cross-sectional view of a second embodiment of a closed nozzle injector used in the fuel system of FIG. 1.

Referring now to FIG. 3, an alternative embodiment of a fuel injector 126 is shown which may be used in conjunction with the needle controlled, common rail fuel system of the present invention instead of the embodiment of FIG. 2. Fuel injector 126 contains the same injection actuator module 58 and nozzle module 60 described hereinabove in relation to the embodiment of FIG. 2. However, fuel injector 126 does not include a fuel intensifier module 56 but instead merely includes an outer barrel 128 having an inlet passage 130 and a connector passage 132 for delivering fuel from the common rail to passage 116 formed in spacer 96. Thus, injector 126 is especially advantageous in those applications in which very high, intensified fuel pressures are not necessary or where very high fuel pressure is provided in the common rails by the respective high pressure pumps.

Figure 8:
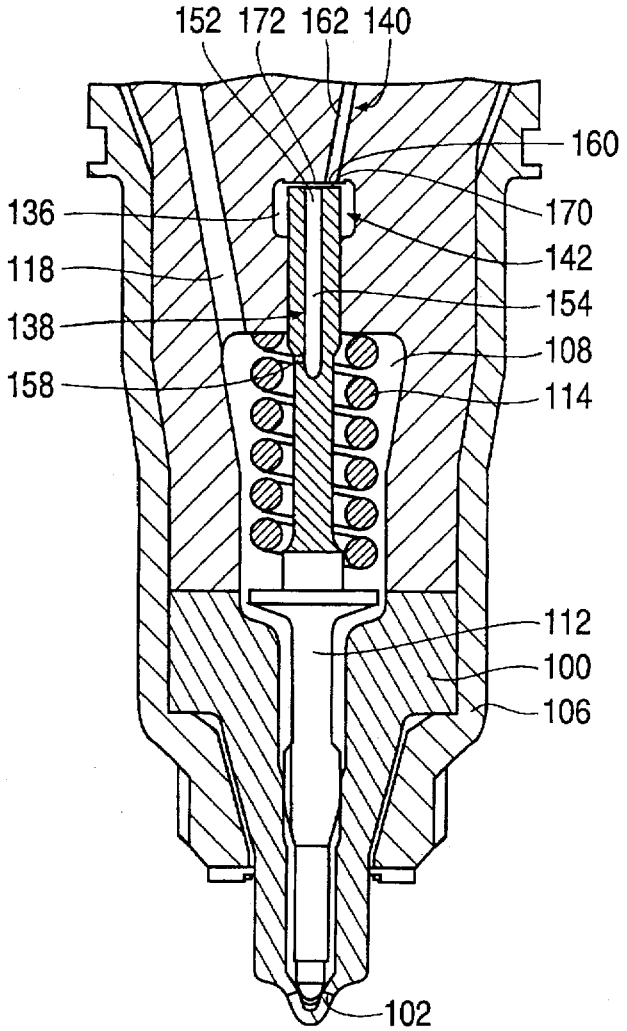
FIG. 8 is an enlarged, partial cross-sectional view of the injector of FIGS. 2 and 3 showing the dual port closing feature of the present invention.

Both injector embodiments of FIGS. 2 and 3 further include a needle valve control device 134 for moving the needle valve element 112 between its open and closed positions. As shown in FIGS. 2, 3 and 8, needle valve control device 134 includes a control volume or cavity 136 formed in outer nozzle housing 104 adjacent the outer end of needle valve element 112, and a control volume charge circuit 138 for directing fuel from needle cavity 108 into control volume 136. Needle valve control device 134 also includes a drain circuit 140 formed partially in outer nozzle housing 104 for draining fuel from control volume 136, and injection control valve 98 which is positioned along drain circuit 140 for controlling the flow of fuel through drain circuit 140 so as to cause the movement of needle valve element 112 between its open and closed positions. A flow limiting device indicated generally at 142 is provided to limit the flow of fuel into and out of control volume 136 when needle valve element 112 is in its open position as described more fully hereinbelow with respect to FIGS. 8–12.

Injector 26 of FIG. 2 and injector 126 of FIG. 3 also each include an electrical valve connector 144 attached to inner housing 68 and outer barrel 128, respectively. Electrical valve connector 144 supplies electrical power to injection control valve 98. Electrical valve connector 144 is used to connect injection control valve 98 to an electrical source without the need for an additional connection step. As described more fully hereinbelow, electrical valve connector 144 is connected to the injector and positioned so as to connect with a wiring connection harness simultaneously with the movement of injector 26, 126 into its respective mounting bore formed in the cylinder head of an engine. Injector 26 may include a plunger position sensing device 146 positioned in larger cavity 70 of outer housing 62 adjacent high pressure plunger 80. Plunger position sensing device 146 may be a linear variable differential transformer for determining the displacement of high pressure plunger 80 so as to provide a signal which can be used to determine the moment of the start of injection, the total injected quantity and the injection rate, thus providing important diagnostic information. In this instance, electrical valve connector 144 would also provide the necessary electrical connection to sensing device 146.

Figure 4:
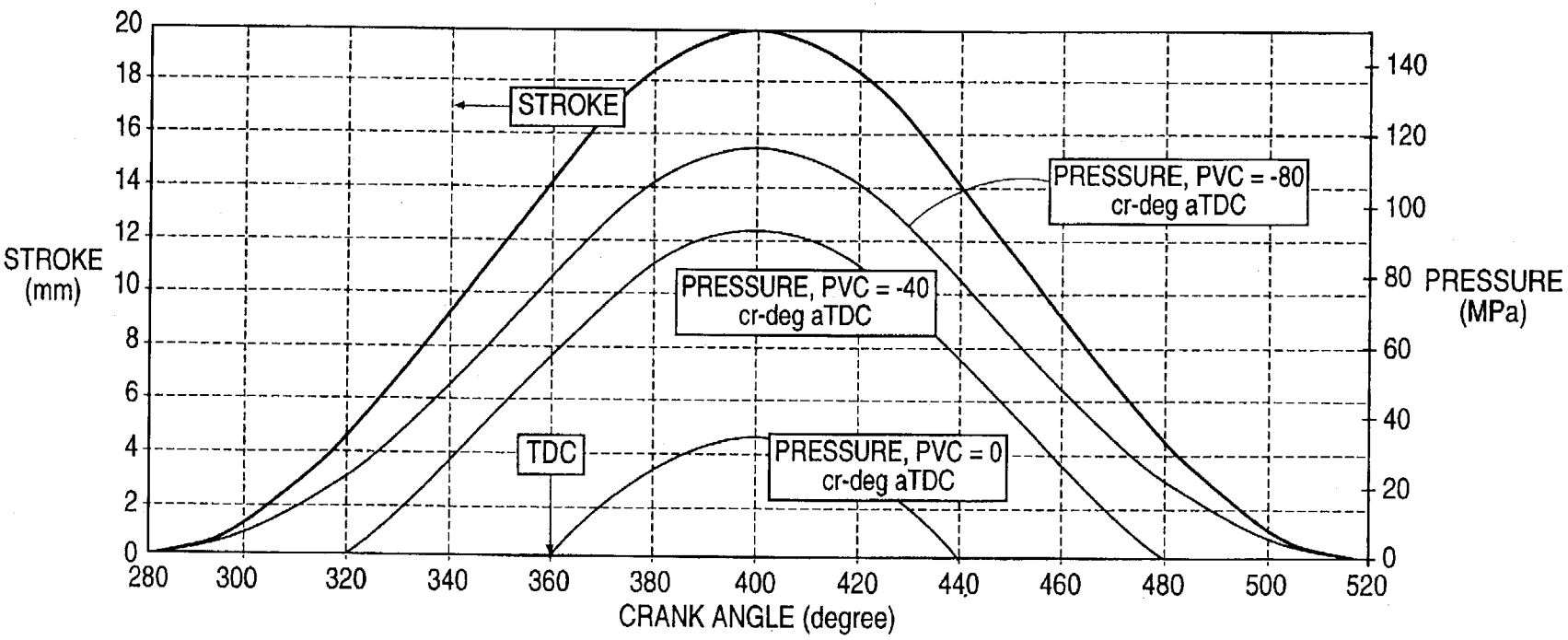
FIG. 4 is a graph showing the variable stroke and pressure capable of being cyclically generated by the high pressure pump of the present system versus crank angle.
Figure 5:
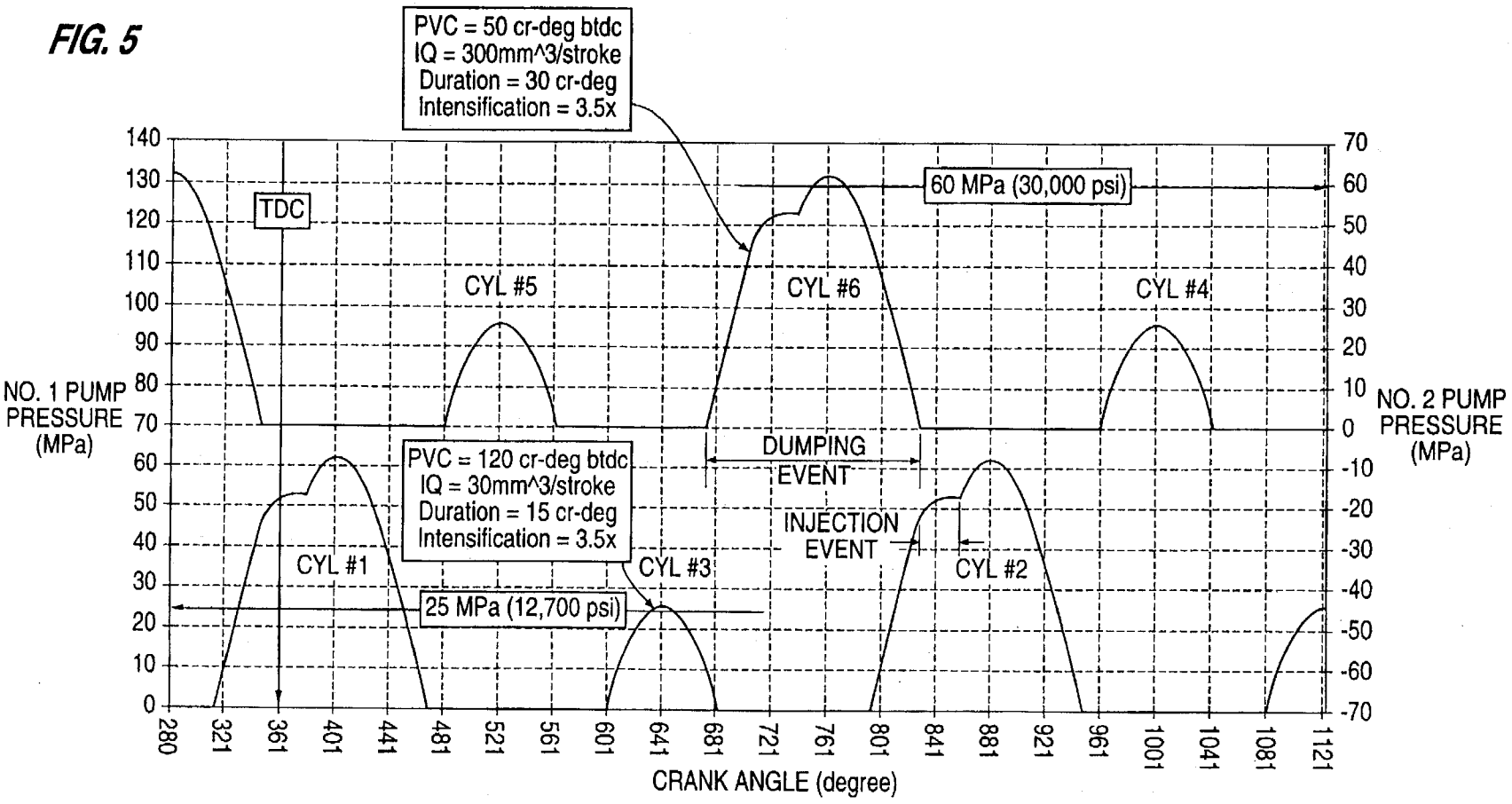
FIG. 5 is a graph showing the cyclically generated pumping events created by the high pressure pump associated with each common rail/set of injectors.

Generally, during operation, plunger 34 of first high pressure pump 14 reciprocates through advancement and retraction strokes as determined by cam 30 while second high pressure pump 16 also reciprocates 180° out of phase with first high pressure pump 14. The stroke of plunger 34 is represented by the top curve in FIG. 4. During the retraction stroke of plunger 34, low pressure fuel in low pressure fuel supply circuit 48 flows through valve port 50 into pump chamber 42 while pump control valve element 46 is in an open position. Whenever pump control valve 46 is in the open position, first common rail 20 will be connected to low pressure fuel supply circuit 48. At some point during the advancement stroke of pump plunger 34, pump control valve 44 will be energized thus moving pump control valve element 46 into a closed position as shown in FIG. 2. Pump plunger 34 will continue through the advancement stroke delivering compressed fuel into common rail 20 and injector 26. At some point during the advancement stroke, pump control valve 44 will be de-energized while the pressure of the fuel in chamber 42 holds valve element 46 in a closed position. During the retraction stroke, when the pressure in chamber 42 reaches a predetermined minimum level, valve element 46 will be moved into an open position allowing supply fuel into chamber 42. Therefore, first high pressure pump 14 and second high pressure pump 16 operate to alternately and cyclically generate high pressures in the respective common rails during each respective pumping event by gradually increasing the fuel pressure in the common rail followed by gradually decreasing the common rail pressure. The duration of the pumping event and the pressure generated in the respective common rail are determined by the timing of closing of pump control valve 44 during the advancement stroke of pump plunger 34. As shown in FIG. 4, a very high pressure level may be reached by closing pump control valve 44 near the beginning of the advancement stroke of pump plunger 34, i.e. 80 crank angle degrees after TDC. As a result, very little fuel present in pump chamber 42 escapes through valve port 50. Thus, a large amount of fuel is compressed into first common rail 20 resulting in extremely high pressures. Of course, later closing of pump control valve 44 permits some of the fuel in pump chamber 42 to be pumped by pump plunger 34 through valve port 50 into low pressure fuel supply circuit 48. As shown in FIG. 4, pump control valve 44 may be closed at various times during the advancement stroke of pump plunger 34 to achieve a variety of desired pressure levels depending on perhaps the operating conditions of the engine. As shown in FIG. 5, pump control valve 44 of each high pressure pump 14, 16 can be operated to create a desired common rail pressure curve for each injection event associated with a respective injector 26 during each cycle of engine operation. Thus, as shown in FIG. 5, pump control valve 44 may be closed early in the advancement stroke of pump plunger 34 for cylinder #1 to create extremely high common rail pressures for injection into cylinder #1 followed by a later closing during the subsequent advancement stroke of the next cycle of pump plunger 34 to generate a significantly lower pressure in common rail 20. Thus, the present system provides optimum control of injection pressure levels during each injection event.

Referring to FIG. 1, the pressure in common rails 20, 24 is sensed by respective pressure sensors 147, 149 connected to the respective rails. Sensors 147, 149 generate pressure signals which are sent to the engine control module (ECM—not shown) for use in controlling and monitoring the engine. For example, the sensors may be used to calculate the energization duration for injection control valve 98. Alternatively, a single differential pressure sensor 151 may be used. Pressure sensor 151 is connected to a pressure sensing passage 153 extending between common rail 20 and common rail 24. As shown in FIG. 5, the pumping events of high pressure pumps 14 and 16 mostly occur at different times so that only one common rail is under pressure while the other rail is the constant supply pressure. Therefore, pressure sensor 151 can be used to effectively detect rail pressure by sensing the differential pressure in the rails. During periods when a pumping event is occurring simultaneously in both common rails 20, 24, the signal from pressure sensor 151 is simply not used until one of the pumping events terminate and the common rail pressure is relieved. The partial pressure trace samples created by differential pressure sensor 151 are used by a model based control algorithm to verify the fact versus command and make corrections in the pressure map as necessary, resulting in a dynamic pressure map.

Figure 6:
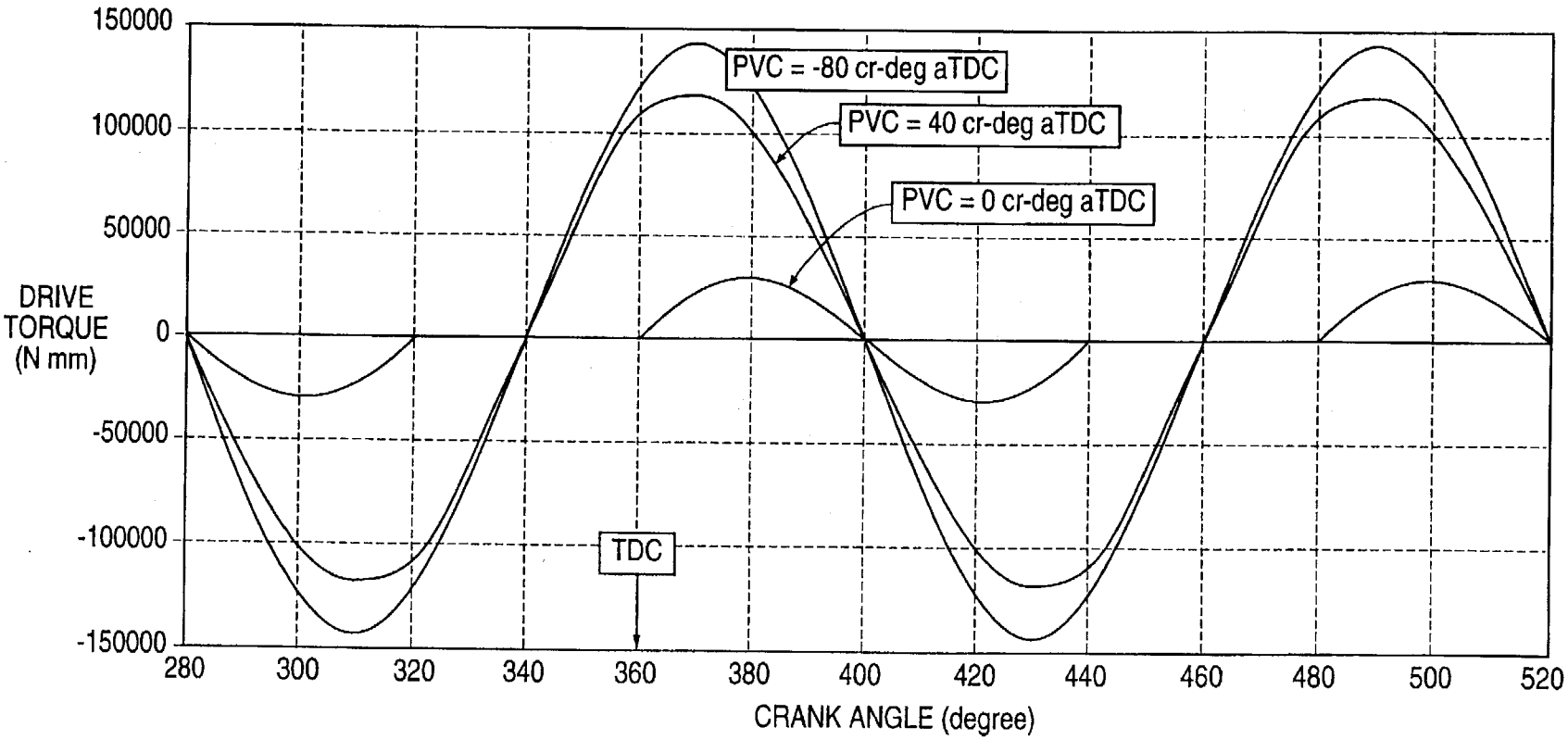
FIG. 6 is a graph showing the drive torque created by the cyclic pressure generation/pumping events versus crank angle assuming no injection and no energy losses.
Figure 7:
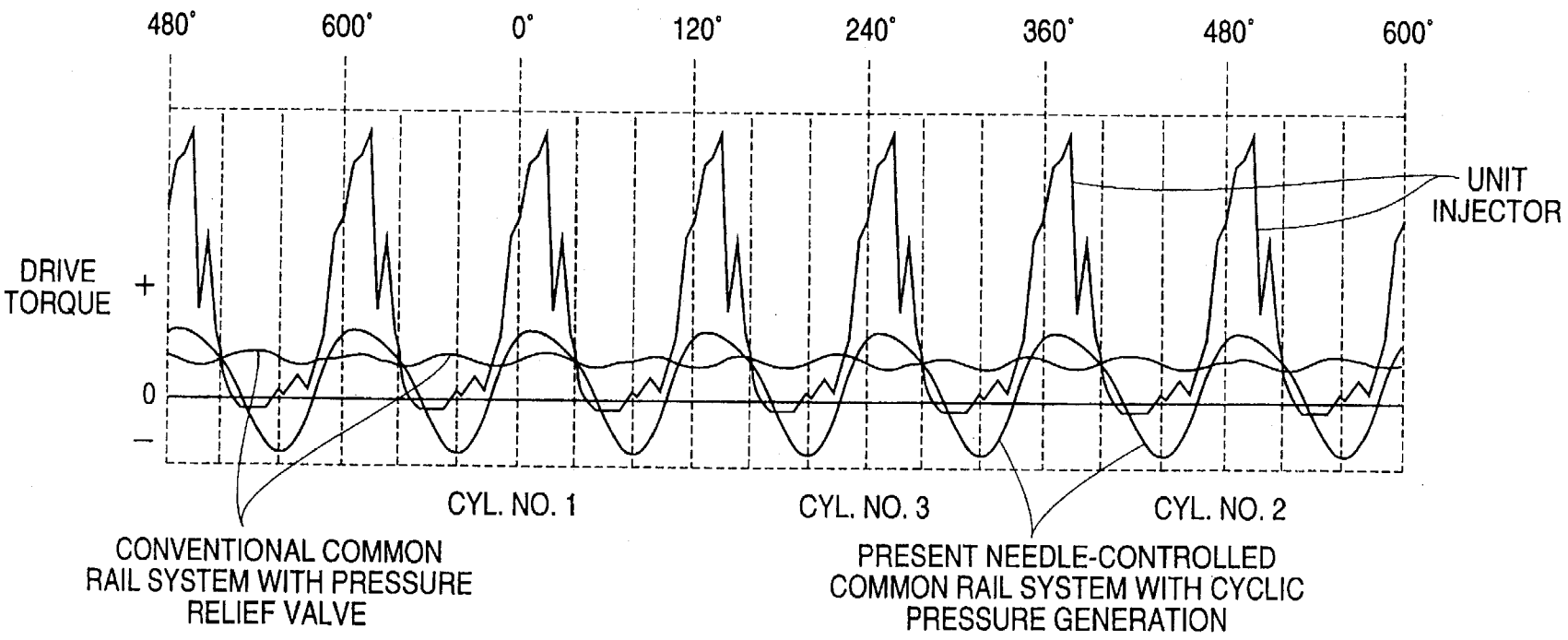
FIG. 7 is a graph showing a comparison of drive torque created by a prior an unit injector, a prior art fuel system having a common rail with a pressure relief valve and the needle controlled common rail fuel system of the present invention.

As shown in FIGS. 4 and 6, the stroke of each pump plunger 34 spans approximately 120 crank angle degrees. As a result, the present system generates fuel pressure in the respective common rails 20, 24 slowly and gradually thus minimizing drive torque fluctuations in the drive system operating pump plunger 34. As shown in FIG. 7, a unit injector having a cam operated plunger assembly generates high drive torque fluctuations resulting in increased drive system wear and noise. In comparison, the present system requires a significantly less amount of drive torque to achieve the necessary injection pressures. Although, the drive torque requirements for a traditional common rail pressure system in which the pressure in the common rail is maintained relatively constant, may be somewhat less than the drive torque fluctuations of the present system, common rail systems suffer from inefficiencies in pressure control. For example, the conventional common rail system cannot efficiently and effectively permit wide varying injection pressures from one injection event to the next. In order to increase the common rail pressure, the conventional common rail system requires a significant amount of time typically spanning several or more injection events before the high pressure pump serving the common rail can raise the pressure to the required level. In addition, conventional common rail systems typically rely on the injection events for removing pressurized fuel to decrease the pressure in the common rail when desired thereby foregoing quick pressure response. Other conventional common rail systems achieve quick decreased pressure response by draining fuel from the common rail which results in inefficiencies. The present system, on the other hand, creates a specific, tailored fuel pressure curve for each pumping event, and thus for each injection event as desired. The present system also possesses the flexibilities of conventional common rail systems in that it separates the pressure generation event from the injection event to limit drive torque fluctuations, permits pressure control independent from engine speed, creates an extended injection timing range during which injection may occur, and provides extremely fast injection response time by providing simultaneous metering and injection.

Another important feature of the present fuel system is the integration of a pressure energy recuperation means 150 for assisting in the retraction of the respective pump plunger 34 during each retraction stroke. Pressure energy recuperation means 150 utilizes the pressure of the fuel in the respective common rail as a result of the energy stored in the fuel due to the elastic compressibility of the fuel to drive the pump plunger 34 through its retraction stroke thus recuperating the pressure energy in the fuel and resulting in a more efficient system. Pressure energy recuperation means 150 generally includes the provision of maintaining fluidic communication between first and second common rails 20, 24 and the respective pump chamber 42 throughout the retraction stroke of pump plunger 34. Pressure energy recuperation means 150 is optimized by also maintaining fluidic communication between fuel transfer circuit 90 and a respective common rail 20, 24. Pressure energy recuperation means 150 includes the use of intensification plunger assembly 76 and the check valve to permit the utilization of the pressure of the fuel in high pressure chamber 74 to also assist in the retraction of the respective pump plunger 34. During a given pumping event, as the pressure in the common rail 20, 24 increases, actuating plungers 78 and high pressure plunger 80 will begin moving inwardly toward high pressure chamber 74 when the fuel pressure in common rail 20 reaches a level such that the fuel pressure forces acting on actuating plunger 78 and check valve 95 are sufficient to overcome the bias force of spring 82. Check valve 95 is biased by a spring of sufficient bias force capable of permitting a supply flow of fuel into high pressure chamber 74. As the pressure in common rail 20 continues to increase, actuating plunger 78 and high pressure plunger 80 continue to move inwardly causing a dramatic increase in the pressure of the fuel in high pressure chamber 74. As will be explained more fully hereinbelow, at a predetermined time during the pumping event, injection control valve 98 is energized into an open position so as to cause the movement of needle valve element 112 from the closed position into an open position. High pressure fuel in needle cavity 108 flows outwardly through injection orifices 102 into an engine cylinder (not shown) as high pressure plunger 80 continues downwardly pressurizing the fuel in high pressure chamber 74 and needle cavity 108. After a predetermined period of time, injection control valve 98 is de-energized and moved into a closed position which causes needle valve element 112 to move into a closed position blocking flow through injection orifices 102 thus ending the injection event. Typically, an injection event will occur during the advancement stroke of plunger 34 of high pressure pump 14 as shown in FIG. 5. Consequently, after the injection event, pump plunger 34 will complete its advancement stroke and then enter the retraction stroke. As plunger 34 begins its retraction stroke, the high pressure fuel in first common rail 20, actuating chamber 88 and fuel transfer circuit 90 upstream of check valve 95, will expand back into pump chamber 42. The expanding fuel imparts pressure forces on the top portion of pump plunger 34 thereby assisting plunger 34 in moving through its retraction stroke. These forces are in turn transmitted into cam device 30 and the upstream driving system thus returning or recuperating previously generated pressure energy to create a more efficient pumping arrangement. In addition, high pressure fuel in needle cavity 108, fuel transfer circuit 90 downstream of check valve 95 and high pressure chamber 74 creates pressure forces on high pressure plunger 80 forcing plunger 80 and actuating plunger 78 outwardly which in turn forces fuel in actuating chamber 88 and first common rail 20 into pump chamber 42. As a result, the pressure energy in the fuel downstream of check valve 95 is used to assist in the retraction of pump plunger 34. Thus, the pressure energy stored in the pressurized fuel in the system from pump chamber 42 through the respective common rail 20, 24 and the fuel transfer circuit all the way to needle cavity 108 is recuperated during each pumping event. Moreover, during each pumping event, all injectors associated with the respective high pressure pump are pressurized and each intensification plunger assembly 76 reciprocated in the above described manner. Thus, during each pumping event the entire bank of injectors associated with a given common rail and high pressure pump are used to recuperate the pressure energy in the fuel by permitting the pressurized fuel to effectively expand through the injector, common rail and high pressure pump to assist in the retraction of pump plunger 34. Ultimately, the recuperated pressure forces acting on pump plunger 34 and cam 30 are used to assist in rotating cam 30 and thus assist in moving the other high pressure pump plunger 34 through its advancement stroke, and/or operate any other devices driven by cam device 30.

The present invention also integrates the common rail function of storing pressure energy into each of injectors 26. The actuating chamber 88 and fuel transfer circuit 90 of each injector 26 of a set of injectors 18, 22 will receive high pressure fuel during each pumping event while only one injector of the group will undergo an injection event. During the injection event, the intensification plunger assembly 76, of the injector undergoing the injection event, will begin to move inwardly more rapidly as fuel flows out of the injector orifices 102 and thus high pressure chamber 74. During the injection event, the fuel in the actuating chamber 88 and fuel transfer circuit 90 of the remaining injectors will expand, and be pushed by the respective intensifier assemblies 76, back into the common rail and actuating chamber 88 of the injector injecting. This design advantageously permits the volume of the common rail to be minimized.

FIG. 6 illustrates the drive torque at cam device 30 resulting from the cumulative effect of first high pressure pump 14 and second high pressure pump 16. The negative drive torque represents torque resulting from the recuperation of stored fuel pressure energy acting on the cam device 30. Although FIG. 6 represents an ideal scenario assuming no energy losses, a more realistic drive torque curve is shown in FIG. 7 wherein the negative drive torque, i.e. recuperated energy is less than the drive torque generated by cam 30. A drive torque curve for a single pumping element would have a similar shape to that shown in FIG. 7 except the sinusoidal curve would occur with half the frequency. Thus the present system effectively recuperates a significant amount of the unused pressure energy in the fuel during each pumping event to assist in the retraction of pump plunger 34. As shown in FIG. 7, in comparison to a unit injector, the present needle controlled, common rail system requires significantly less drive torque and recuperates a substantial amount of the unused energy unlike a conventional unit injector.

As shown in FIG. 4, the drive system including cam 30 has been designed to reciprocate pump plunger 34 relative to the reciprocation of the engine piston such that the top dead center of pump plunger 34 occurs 40° crank angle after top dead center of the engine piston. Since an injection event typically occurs around top dead center of the engine piston or soon thereafter, the injection event will occur during the pumping event as the pressure in the common rail increases as shown in FIG. 5. Therefore, the drive system can be tuned during initial installation so as to phase the reciprocation of pump plunger 34 at a desired time relative to the top dead center of the engine piston so as to achieve a specific injection rate shaping performance. For example, the first high pressure pump 14 could be phased so that the top dead center of pump plunger 34 occurs approximately at the same time as, or possibly before, the top dead center of the piston. For each different phase setup, a different fuel injection pressure rate change will occur resulting in a unique injection flow rate.

Figure 9:
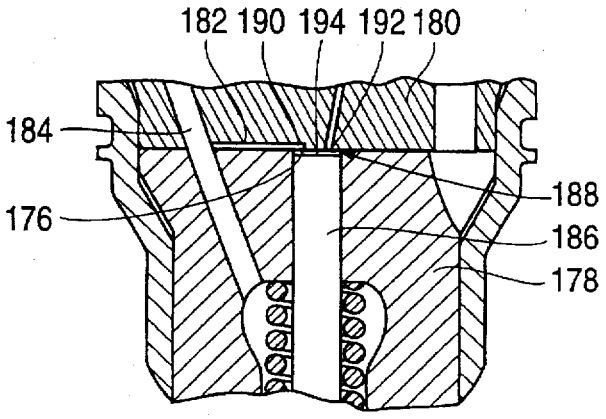
FIG. 9 is an enlarged, partial cross-sectional view of an injector used in the present invention including a second embodiment of the dual port closing feature of the present invention.

Referring now to FIGS. 2, 8 and 9, another important feature of the present fuel system is the improved flow limiting device 142 which functions to minimize the flow of high pressure fuel to drain during an injection event while permitting optimum control of needle valve element 112. Flow limiting device 142 includes a control volume inlet port 152 formed in the end of needle valve element 112 for fluidically connecting control volume charge circuit 138 with control volume 136. Control volume charge circuit 138 includes an axial passage 154 extending axially through needle valve element 112 from control volume inlet port 152 and an orifice 158 extending transversely from axial passage 154 to communicate with needle cavity 108. Flow limiting device 142 also includes a control volume outlet port 160 formed in outer nozzle housing 104 in communication with control volume 136 and drain circuit 140. Drain circuit 140 includes a drain passage extending from control volume outlet port 160 to open at an opposite end immediately adjacent injection control valve 98. As shown in FIG. 2, injection control valve 98 includes a control valve element 164. Preferably, injection control valve 98 is of the two-way, solenoid-operated type including a coil assembly 166, capable of moving valve element 164 between a closed position blocking flow through drain passage 162 and an open position permitting drain flow through drain passage 162. However, the actuator for injection control valve 98 may alternatively be of the piezoelectric or magnetostrictive type. Fuel flow from drain passage 162 is directed to a drain outlet 168 for delivery to a low pressure drain. Flow limiting device 142 further includes a flow limiting valve formed on the outer end of needle valve element 112 for substantially reducing the flow through both control volume inlet port 152 and control volume outlet port 160.

During operation, prior to an injection event, injection control valve 98 is de-energized and valve element 164 positioned in the closed position as shown in FIG. 2. The fuel pressure level experienced in high pressure chamber 74 is also present in needle cavity 108, control volume charge circuit 138 and control volume 136. As a result, the fuel pressure forces acting inwardly on needle valve element 112, in combination with the bias force of spring 114, maintain needle control valve element 112 in its closed position blocking flow through injection orifices 102 as shown in FIG. 8. At a predetermined time during a given pumping event by a respective high pressure pump 14, 16, injection control valve 98 is energized to move valve element 164 into an open position causing fuel flow from control volume 136 through drain passage 162 to the low pressure drain. Simultaneously, high pressure fuel flows from needle cavity 108 through orifice 158 and axial passage 154 of charge circuit 138 and into control volume 136 via control volume inlet port 152. However, orifice 158 is designed with a smaller cross sectional flow area than drain circuit 140 and thus a greater amount of fuel is drained from control volume 136 than is replenished via control volume charge circuit 138. As a result, the pressure in control volume 136 immediately decreases. Fuel pressure forces acting on needle valve element 112 due to the high pressure fuel in needle cavity 108, begin to move the valve element 112 outwardly against the bias force of spring 114. As the outer end of needle valve element 112 approaches a valve surface 172 forming control volume 166, flow limiting valve 170 begins to simultaneously block both control volume outlet port 160 and control volume inlet port 152 thereby limiting the flow into and out of control volume 136.

Figure 10:
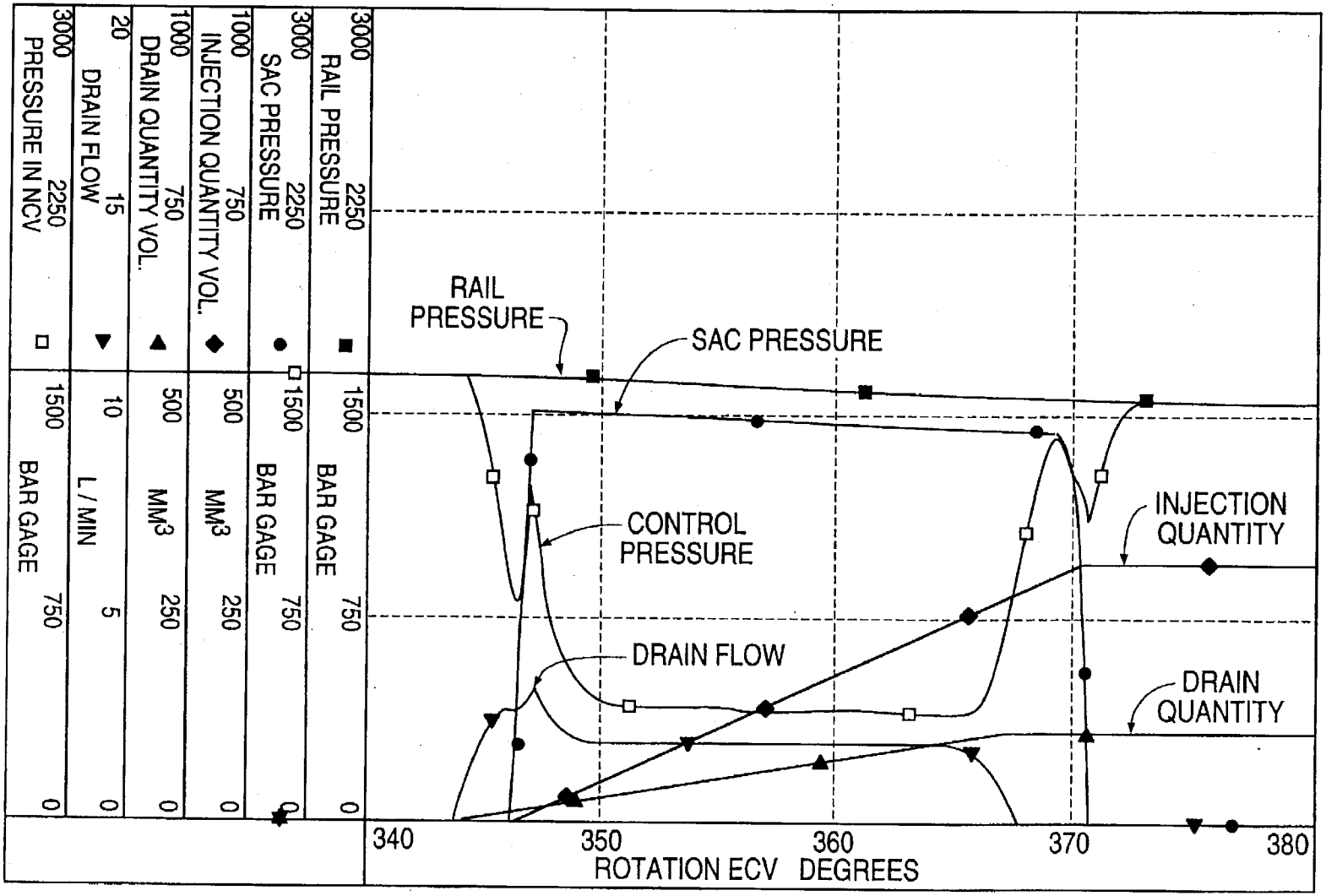
FIG. 10 is a graph showing various fuel pressures and quantities during an injection event of a conventional needle controlled injector without any closing of the inlet and outlet ports associated with the control volume.
Figure 11:
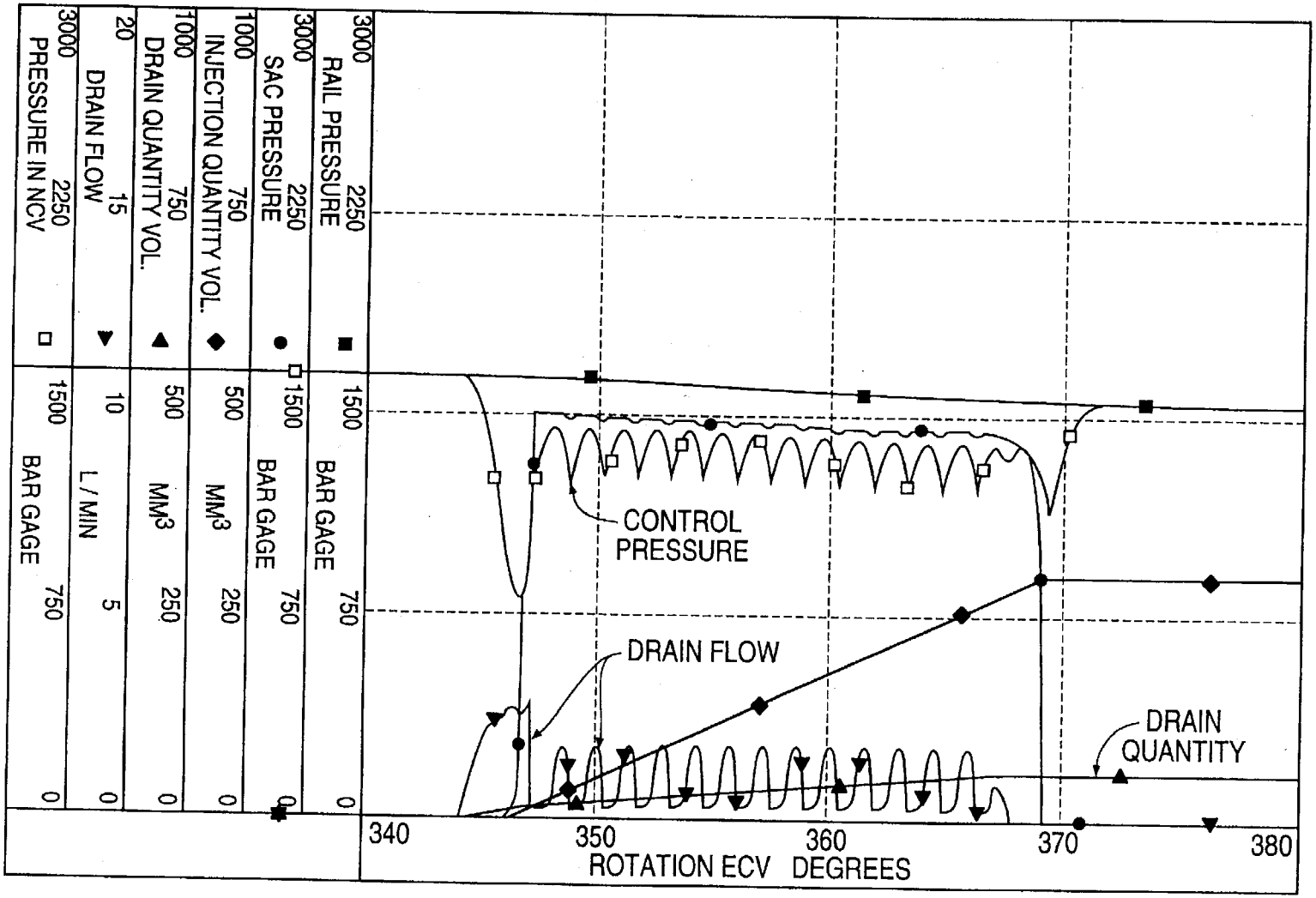
FIG. 11 is a graph of various fuel pressures and quantities during an injection event created by a prior an injector which closes only the needle control volume outlet port.
Figure 12:
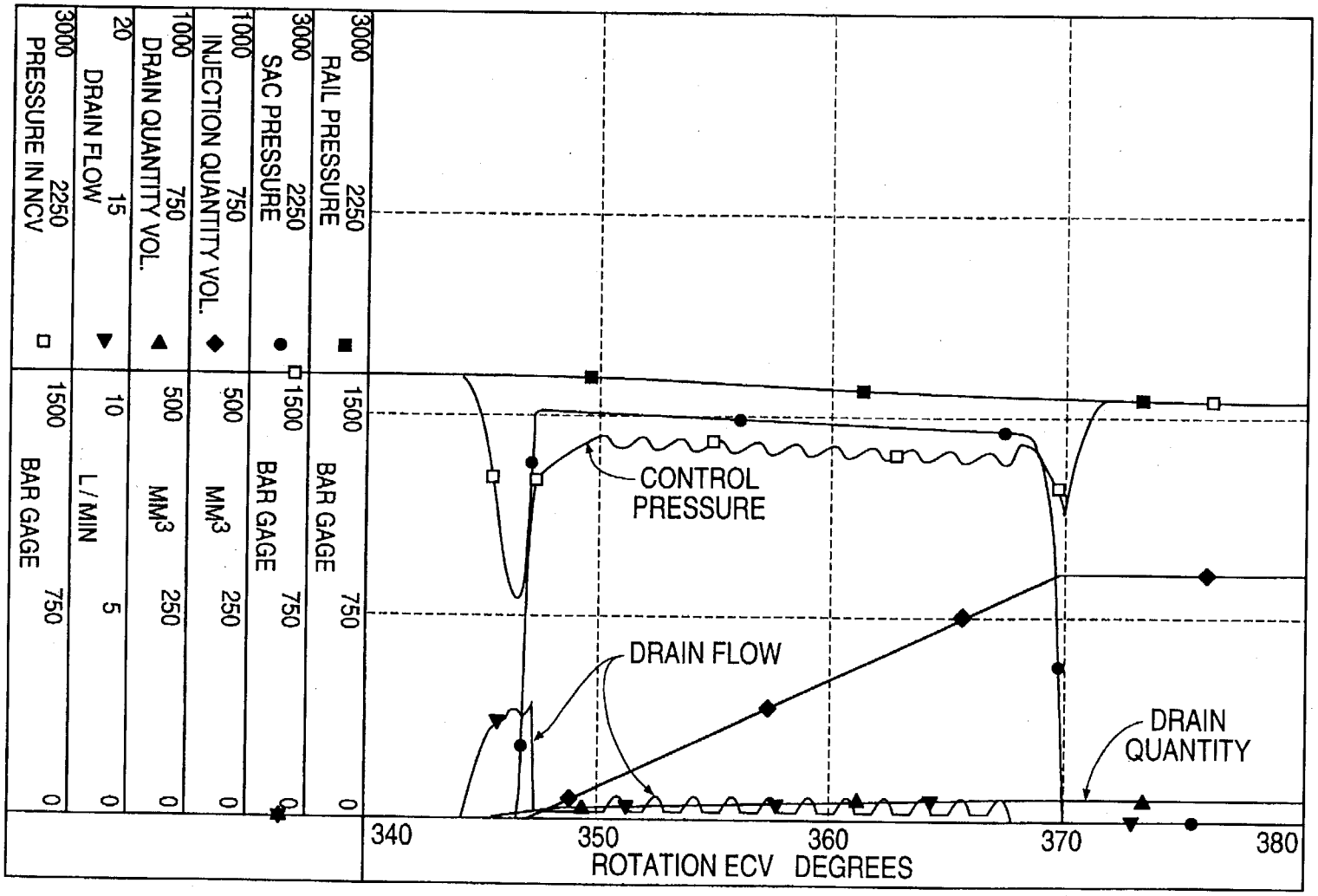
FIG. 12 is a graph showing various fuel pressures and quantities during an injection event created by the injector of the present invention with the flow limiting device of the present invention for substantially closing both inlet and outlet ports of the control volume.

Referring to FIGS. 10–12, it can be seen that flow limiting device 142 advantageously minimizes the amount of fuel during an injection event. FIG. 10 represents a needle controlled injector incorporating a control volume without a device for limiting the flow through the inlet and outlet ports while FIG. 11 illustrates a similar injection event in a needle controlled injector only capable of reducing the flow through the outlet port from the control volume leading to drain. As can be seen by comparing FIGS. 10 and 11, an injector having the ability to at least partially block the control volume outlet port reduces the drain flow and drain quantity of fuel during an injection event in comparison to an injector without needle control volume port closing capability. In addition, the single port closing injector of FIG. 11 is capable of increasing the control pressure, i.e. fuel pressure in the control volume 136, so as to permit a quicker closing of the control valve element. However, flow limiting device 142 of the present invention further significantly decreases the fuel drain flow and quantity during the injection event while maintaining quicker needle valve closing in comparison to an injector having no control volume port closing. In addition, it can be seen that although the injector of FIG. 11 maintains the control pressure in control volume 136 relatively high to permit a quick valve closing, the control pressure fluctuates to create pulses during the injection event. These high level pulses may create unstable pressure balance conditions tending to move needle control valve element 112 toward its closed position disadvantageously affecting or interrupting the quantity of fuel injected. As shown in FIG. 12, the flow limiting device 142 of the present invention dampens or minimizes the pressure pulsations in control volume 136 by substantially blocking the flow through control volume inlet port 152 so as to ensure that the control pressure is maintained well below the opposing sack pressure acting on the opposite end of the needle valve element. Thus, the present flow limiting device 142 advantageously stabilizes the control pressure in control volume 136 throughout an injection event so as to ensure that needle valve element 112 is reliably maintained in an optimum open position during the injection event.

FIG. 9 illustrates a second embodiment of the flow limiting device of the present invention wherein a control volume 176 is formed between a nozzle housing 178 and an actuator housing or spacer 180. A control volume charge passage 182 is formed in the lower surface of spacer 180 facing nozzle housing 178 so as to communicate at one end with control volume 176 and at an opposite end with a fuel delivery passage 184. Therefore, instead of forming the charge circuit in the needle valve element 186, the present embodiment supplies fuel from fuel delivery passage 184, as opposed to needle cavity 108, to control volume 176 via charge passage 182 formed in spacer 180. Alternatively, control volume charge circuit 182 may be formed in the outer surface of nozzle housing 178 facing spacer 180. The flow limiting device 188 of this embodiment is similar to that of the previous embodiment in that it includes a control volume inlet port 190, a control volume outlet port 192 and a flow limiting valve 194 formed on the end of needle valve element 186. As needle valve element 186 moves into an open position to begin injection, flow limiting valve 194 substantially blocks the flow through control volume outlet port 192 and control volume inlet port 190 resulting in the advantages discussed hereinabove in relation to the embodiment of FIG. 8.

In both the embodiments of FIGS. 8 and 9, during operation, at the end of an injection event, injection control valve 98 is de-energized and valve element 164 moved into a closed position blocking flow through drain circuit 140 as shown in FIG. 2. As a result, fuel pressure in control volume 136, 176 immediately increases as high pressure fuel flows into control volume 176 via control volume charge circuit 138, 182. Consequently, the high pressure fuel present in control volume 136 and needle cavity 108 acts on the needle valve element 112 to create fuel pressure forces which in combination with the bias force of spring 114 overcome the fuel pressure forces on needle valve element 112 acting in the opposite direction, thereby closing needle valve element 112 and terminating injection.

Figure 13:
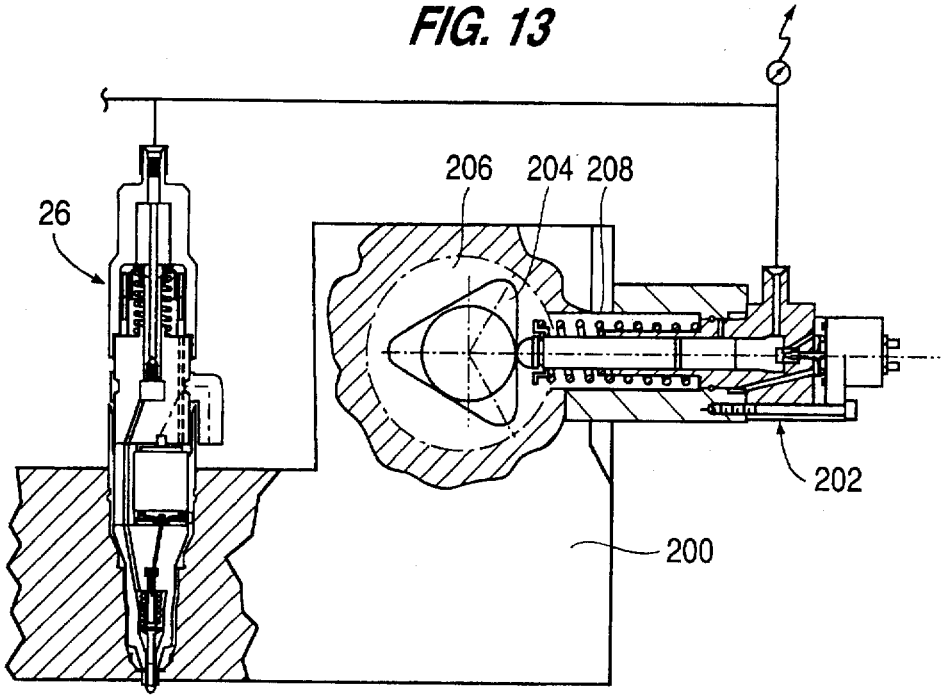
FIG. 13 is another embodiment of the present system showing a modified packaging arrangement with the high pressure pump mounted on the side of a cylinder head and operated by a cam positioned in the head.

FIG. 13 illustrates another embodiment of the present fuel system including fuel injector 26 of the embodiment shown in FIG. 2 as mounted in a cylinder head 200 of an engine. In this embodiment, a high pressure pump 202 which is very similar to high pressure pump 14 of FIG. 2 except that the pump is operated by a three-lobed cam 204 rotating at half the engine rpm. Cam 204 is mounted in a cam bore 206 formed in cylinder head 200 in communication with a pump cavity 208 extending through one side of cylinder head 200. This arrangement permits mounting of high pressure pump 202 on one side of cylinder head 200. This mounting arrangement may be advantageous in specific applications where the overall height of the engine must be minimized or ample space is available on the side of head 200.

Figure 14:
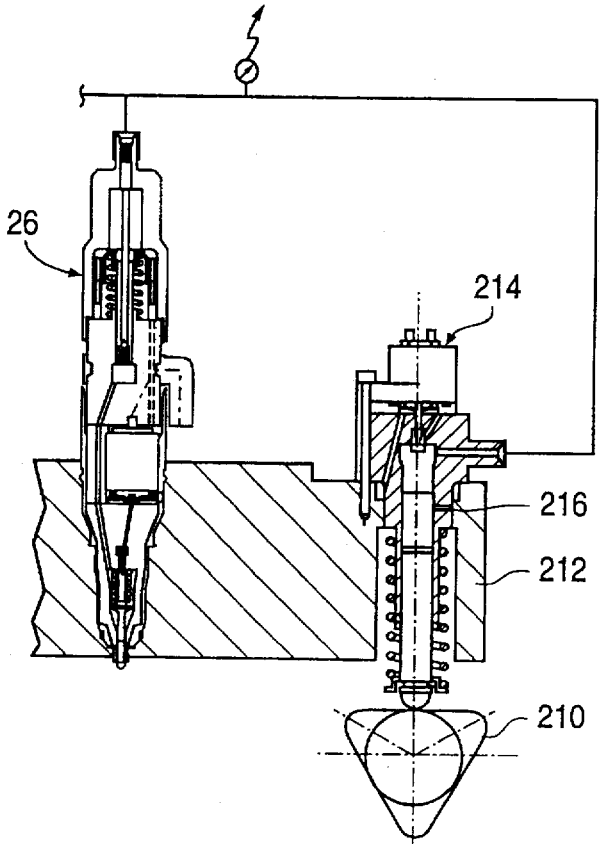
FIG. 14 is yet another embodiment of the present invention showing another packaging variation with the high pressure pump mounted vertically in the cylinder head.

FIG. 14 discloses yet another arrangement for packaging the present fuel system wherein a three-lobed cam 210 is positioned in the engine below a cylinder head 212 containing a high pressure pump 214. High pressure pump 214 is mounted on the top of head 212 and extends through a pump mounting bore 216 formed in head 212 to engage cam 210.

Figure 15:
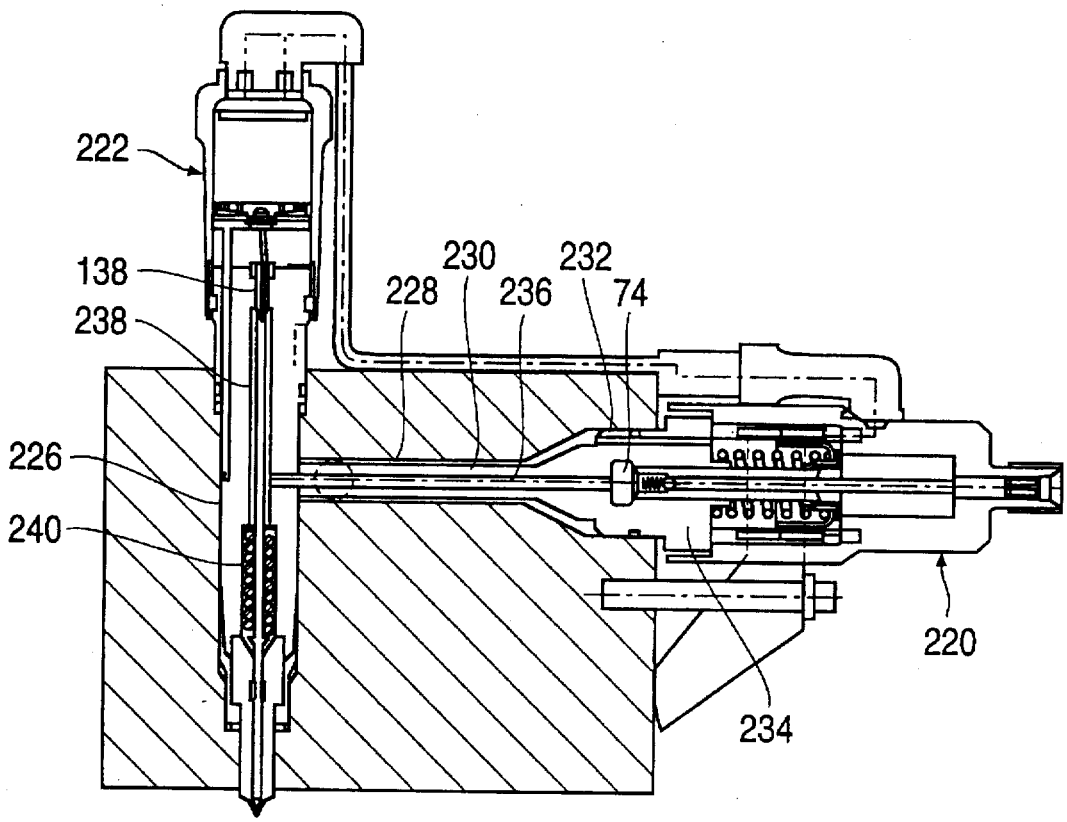
FIG. 15 is yet another embodiment of the present invention including a needle controlled injector and a separate intensification plunger assembly mounted in a separate mounting bore on the cylinder head.

FIG. 15 represents an alternative embodiment of the present fuel system wherein a fuel intensification plunger assembly 220 is formed separately from an injector 222. In this manner, fuel intensification plunger assembly 220 may be mounted in a different, remote location in the engine, for example, on the side of the engine cylinder head 224, while the injector remains positioned in an injector mounting bore 226 extending vertically from top to bottom through head 224. Cylinder head 224 includes a bore 228 including an elongated portion 230 opening into a larger portion 232. Fuel intensification plunger assembly 220 includes an inner housing 234 which extends into larger portion 232 and elongated portion 230. The inner end of elongated portion 230 includes a conical surface for engaging a complementary recess formed in the injector body of injector 222 to create a fluidically sealed joint. A high pressure delivery passage 236 extends from high pressure chamber 74 through elongated section 230 to communicate with an annular cavity 238 formed in the injector body. Annular cavity 238 communicates at one end with a needle cavity 240 and at an opposite end with control volume charge circuit 138. The operation of this embodiment is the same as that described hereinabove in relation to the primary embodiment of FIGS. 1, 2 and 8. The embodiment of FIG. 15 is especially advantageous in those applications in which the space available in the engine overhead is limited. By separating the fuel intensification plunger assembly from the injector, this embodiment permits the use of a shorter injector to permit the use of this fuel system in applications having restricted packaging constraints by minimizing the height of the engine.

Figure 16:
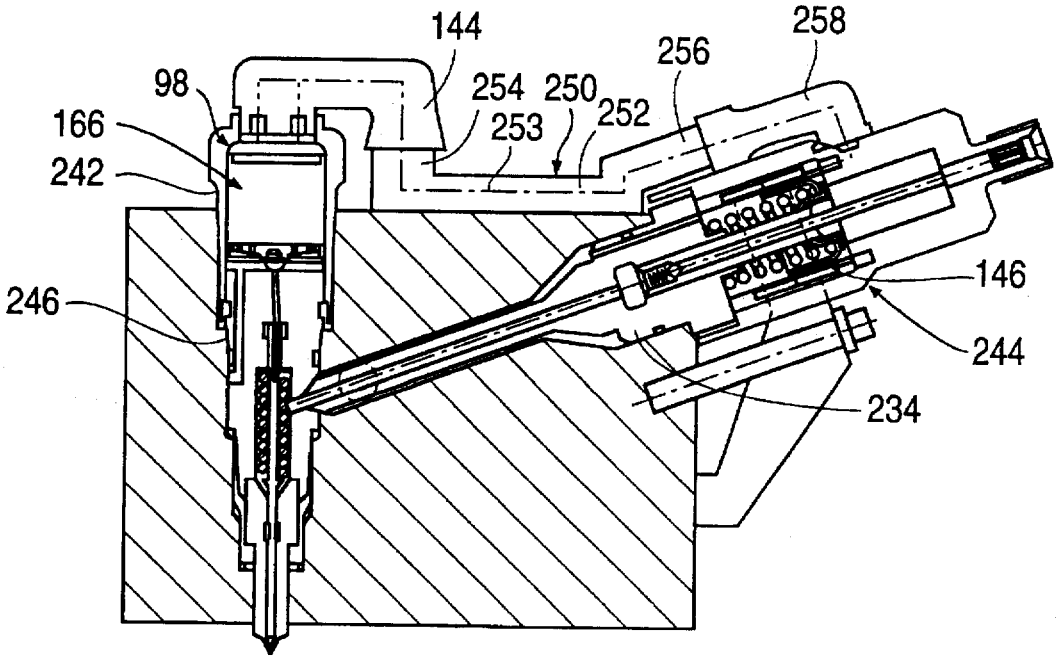
FIG. 16 shows an alternative embodiment of the present invention including a needle controlled injector, a separate intensification plunger assembly and a wiring connection harness for permitting simultaneous electrical connection oft he injector and the intensification plunger assembly during mounting.

FIG. 16 illustrates yet another embodiment of the present fuel system similar to the embodiment of FIG. 15 except that the fuel injector 242 is significantly shorter than that shown in FIG. 15, and more importantly, a fuel intensification plunger assembly 244 is positioned at an angle to fuel injector 242. By using a shorter injector, this embodiment reduces the required engine overhead space thus minimizing the size of the engine and/or permitting the use of the present system on a greater variety of engines. By positioning fuel intensification plunger assembly 244 at an angle relative to fuel injector 242 such that the force of inner housing 234 against the injector body tends to move the injector body inwardly into its mounting bore 246, this embodiment aids in securely and sealingly mounting fuel injector 242 in its bore 246.

FIG. 16 also illustrates another important aspect of the present invention in providing an improved electrical connection device for connecting the actuator assembly, i.e. solenoid/coil assembly 166 of injection control valve 98 to an electrical source. The electrical connection device includes a wiring connection harness indicated generally at 250 which includes a harness body 252 formed of an insulating jacket covering conductive elements represented by dashed lines 254. Harness body 252 further includes a first connector 254 formed on one end thereof for connection to the valve connector 144 extending from injection control valve 98. Harness body 252 is fixedly connected or attached to the top surface of the cylinder head in a fixed predetermined position relative to injector mounting bore 246 such that movement of fuel injector 242 into its mounting bore 246 simultaneously creates a connection between valve connector 144 and first connector 254 of harness body 252. A secure electrical connection between valve connector 144 and first connector 254 is completed when fuel injector 242 is completely secured in its innermost position within injector mounting bore 246. Thus, wiring connection harness 252 simplifies the process of installing and connecting fuel injector 242 by requiring only a single step of inserting and securing fuel injector 242 in its mounting bore 246 without the need for an additional step of connecting injection control valve 98 to an electrical source. Conventional installation of prior art fuel injectors requires installation personnel to physically disconnect and reconnect valve connector 144 to an electrical plug during each removal and reinstallation of fuel injector 242. Thus, the present wiring connection harness 250 advantageously simplifies the installation and removal process of fuel injector 242. In addition, harness body 252 may also include a second connector 256 positioned to engage a displacement sensor connector 258 extending from fuel intensification plunger assembly 244. Displacement sensor connector 258 also includes an outer insulating jacket surrounding a conductive element. The conductive element is connected to the plunger position sensing device 146 for providing diagnostic information as discussed hereinabove. Second connector 256 is positioned relative to bore 228 such that movement of fuel intensification plunger assembly 244 into a secured position within bore 228 as shown in FIG. 16 causes the displacement sensor connector 258 to simultaneously engage second connector 256 to create a secure electrical connection. Valve connector 144, harness body 252 and displacement sensor connector 258 are each preferably formed of a material having sufficient rigidity to permit solid connections without further support by other components or personnel during connection. Also, it should be understood that wiring connection harness 250 may be used with all embodiments of the present invention or any other fuel delivery device including an electrically operated device for mounting on an engine.

Figure 17:
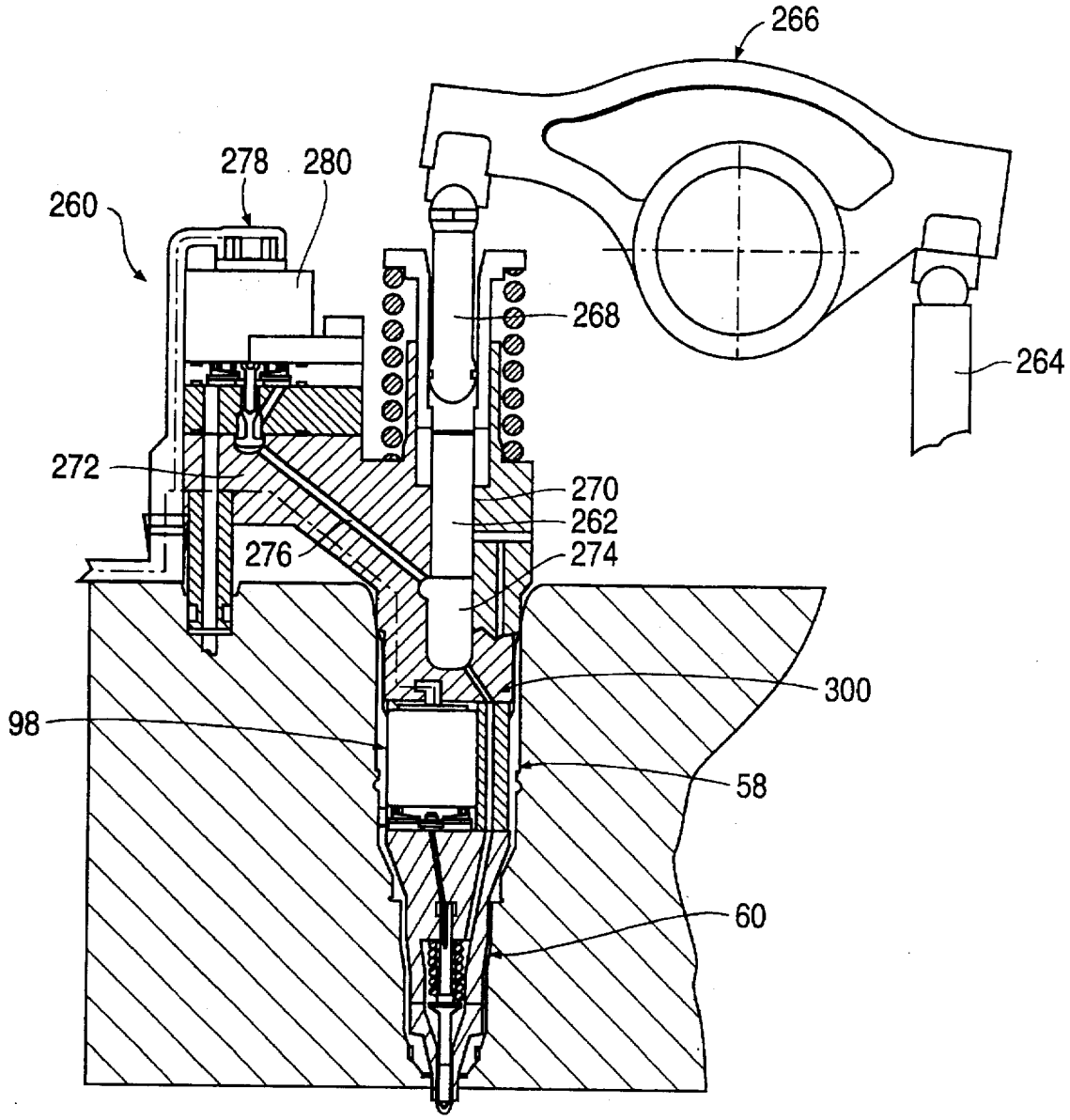
FIG. 17 is a cross-sectional view of a unit injector of an alternative embodiment of the present invention positioned in a mounting bore of a cylinder head.

FIG. 17 illustrates an alternative embodiment including a unit injector 260 having the same injection actuator module 58, nozzle module 60 and retainer 106 of the primary embodiment shown in FIG. 2. However, unit injector 260 includes an injector plunger 262 driven by a cam (not shown) via a conventional pushrod 264, rocker arm assembly 266 and link assembly 268. Injector plunger 262 is positioned in a plunger bore 270 formed in an injector barrel 272 mounted in abutment with injection actuator module 58. A high pressure chamber 274 formed in the inner end of bore 270 is supplied with low pressure supply fuel via a supply passage 276 formed in barrel 272. A solenoid operated pressure control valve 278 including a solenoid coil assembly 280 is positioned to control the flow of supply fuel through delivery passage 276 so as to define a high pressure pumping event. When used in a six cylinder engine, the cam (not shown) causes injector plunger 262 to reciprocate through a pressurizing stroke of approximately 120 crank angle degrees similar to the stroke of pump plunger 34 of the embodiment shown in FIGS. 1 and 2. Likewise, injection control valve 98 operates during each pumping event to create an injection event as discussed hereinabove. This unit injector embodiment is particularly advantageous in providing a simplified needle controlled unit injector having a compact design capable of effectively creating pressurized pumping events independently from the creation of the injection events. By using coil assembly 280 for the pressure control valve 278 which is separate from the actuator coil assembly of injection control valve 98, unit injector 260 permits the operation of injection control valve 98 at any time during the pumping event created by pressure control valve 78 without consideration of the energization of coil assembly 280. This feature is an improvement over prior an needle controlled unit injectors which use the same actuator or coil assembly to operate both the pressure control valve and the injection control valve.

The present system also includes an air purge circuit indicated generally at 300 in FIGS. 1 and 17 which includes low pressure supply circuit 48, outlet passage 52, common rails 20, 24, fuel transfer circuit 90, 276, high pressure chamber 74, 274, needle cavity 108, control volume charge circuit 138 and drain circuit 140. The design of the present system permits fuel to be circulated through the entire fuel supply and drain passage system, i.e. air purge system 300, to direct any air in the system to drain via drain circuit 138. Air purge system 300 includes an electric pump 302 actuated, for instance, prior to engine start-up by, for example, partial turning of an engine ignition switch. Simultaneously, the pump control valve 44 of each high pressure pump, or pressure control valve 278 of the embodiment of FIG. 17, are deenergized, and the injection control valves 98 are energized into the open position. The electric pump 302 supplies fuel to the fuel passages of the system through valves 44, 278 and 98 at a fuel pressure sufficient to overcome the spring pressure of check valve 95. Thus, air purge system 300 effectively eliminates air from the fuel passages of the present system thereby minimizing the deleterious effects of air pockets on the timing and metering of injection event resulting in predictable and reliable fuel metering and timing.

INDUSTRIAL APPLICABILITY

While the needle controlled fuel system of the present invention is most useful in a compression ignition internal combustion engine, it can be used in any combustion engine of any vehicle or industrial equipment in which accurate, efficient and reliable pressure generation, injection timing and injection metering are essential.

We claim:

1. A fuel injection system for controlling fuel injection into combustion chambers of a multi-cylinder internal combustion engine, comprising:

a fuel supply means including a low pressure fuel supply for supplying fuel at a low supply pressure and a first common rail fluidically connectable to said low pressure fuel supply;

a first high pressure pump for receiving low pressure supply fuel from said low pressure fuel supply means and cyclically increasing and decreasing the fuel pressure in said first common rail to create sequential pumping events, each of said pumping events including a period of increasing fuel pressure followed by a period of decreasing fuel pressure, said first common rail fluidically connected to said low pressure fuel supply between said pumping events; and a first set of fuel injectors connected to said first common rail for receiving fuel from said first common rail and for injecting fuel at high pressure during respective pumping events into respective combustion chambers of the engine to define respective injection events.

2. The fuel injection system of claim 1, further including a second common rail fluidically connectable to said low pressure fuel supply, a second high pressure pump for receiving low pressure supply fuel from said low pressure fuel supply means and cyclically increasing and decreasing the fuel pressure in said second common rail to create sequential pumping events, each of said pumping events including a period of increasing fuel pressure followed by a period of decreasing fuel pressure, said second common rail fluidically connected to said low pressure fuel supply between said pumping events, and a second set of fuel injectors connected to said second common rail for receiving fuel from said second common rail and for injecting fuel at high pressure into respective combustion chambers of the engine.

3. The fuel injection system of claim 2, wherein each injector of said first and said second sets of fuel injectors includes an injector body containing an injector cavity, a fuel transfer circuit, an injection orifice formed in one end of said injector body and a closed nozzle assembly mounted in said injector cavity, said closed nozzle assembly including a needle valve element reciprocably mounted for movement between a closed position blocking fuel flow through said injection orifice and an open position permitting fuel flow through said injection orifice, each injector of said first and said second sets of injectors further including a needle valve control means for moving said needle valve element between said open and said closed positions.

4. The fuel injection system of claim 3, wherein said needle valve control means includes a control volume positioned adjacent an outer end of said needle valve element, a drain circuit for draining fuel from said control volume to a low pressure drain, and an injection control valve positioned along said drain circuit for controlling the flow of fuel through said drain circuit so as to cause the movement of said needle valve element between said open and said closed positions.

5. The fuel injection system of claim 4, wherein said needle valve control means further includes a control volume charge circuit for supplying fuel from said fuel transfer circuit to said control volume, each of said first and said second sets of fuel injectors further including a flow limiting means for limiting the fuel flow from said control volume to drain when said needle valve element is in said open position, said flow limiting means including a control volume inlet port fluidically connecting said charge circuit and said control volume, a control volume outlet port fluidically connecting said control volume and said drain circuit and a flow limiting valve formed on said outer end of said needle valve element for at least partially blocking said control volume inlet port and said control volume outlet port to limit fuel flow to the low pressure drain.

6. The fuel injection system of claim 2, further including a sensing passage connecting said first and said second common rails and a pressure sensor positioned along said sensing passage for sensing pressure in both said first and said second common rails.

7. The fuel injection system of claim 3, wherein each of the injectors of said first and said second sets of fuel injectors includes a fuel pressure intensification means for pressurizing injection fuel, said fuel pressure intensification means including an actuating plunger and a high pressure plunger reciprocally mounted in said injector cavity, an actuating chamber formed in said injector cavity for receiving fuel from a respective one of said first and said second common rails and a high pressure chamber formed in said injector cavity between said high pressure plunger and said injector orifice, said actuating plunger including an actuating plunger cross sectional area exposed to the fuel in said actuating chamber and said high pressure plunger having a high pressure plunger cross sectional area exposed to fuel in said high pressure chamber, said actuating plunger cross sectional area being greater than said high pressure plunger cross sectional area, said actuating plunger movable in response to the pressure of fuel in said respective common rail to cause movement of said high pressure plunger for pressurizing fuel in said high pressure chamber to a pressure level greater than said actuating fluid pressure level.

8. The fuel injection system of claim 7, wherein said fuel transfer circuit includes a delivery passage formed in said actuating plunger and said high pressure plunger for delivering fuel from said actuating chamber to said high pressure chamber.

9. The fuel injection system of claim 3, wherein each injector of said first and said second set of fuel injectors further includes a plunger means reciprocably mounted in said injector cavity, wherein said plunger means reciprocates during each of said pumping events in response to increasing and decreasing fuel pressure in said first and said second common rails.

10. The fuel injection system of claim 9, further including a plunger position sensing means mounted in said injector cavity for detecting displacement of said plunger means.

11. The fuel injection system of claim 10, wherein said plunger position sensing means includes a linear variable differential transformer.

12. The fuel injection system of claim 2, wherein each of said first and said second high pressure pumps includes a pump plunger mounted for reciprocal movement, a pump chamber formed adjacent a first end of said pump plunger and a pump control valve for controlling the effective displacement of said pump plunger.

13. The fuel injection system of claim 12, further including a pump housing containing said first and second high pressure pumps and a cam means positioned in said pump housing for reciprocating said pump plunger of each of said first and said second high pressure pumps, said first and said second pump plungers positioned in said pump housing on opposite sides of said cam means for reciprocating along a common axis.

14. The fuel injection system of claim 12, wherein said pump control valve includes a pump control valve element extending into said pump chamber.

15. The fuel injection system of claim 13, wherein said cam means is an eccentric cam including a sliding bearing sleeve positioned between said eccentric cam and said pump plunger.

16. The fuel injection system of claim 4, wherein each of said injector bodies includes an injector retainer forming a retainer cavity, a nozzle module mounted in said retainer cavity including an inner nozzle housing and a one-piece outer nozzle housing positioned in abutment with said inner nozzle housing, an injection actuator module positioned in abutment with said outer nozzle housing for supporting said injection control valve, and less than four high pressure joints spaced axially along the injector between said injection control valve and said injection orifice for containing fuel in said fuel transfer circuit.

17. The fuel injection system of claim 16, wherein said less than four high pressure joints include only a first high pressure joint formed between said inner nozzle housing and said outer nozzle housing and a second high pressure joint formed between said outer nozzle housing and said actuator module.

18. The fuel injection system of claim 12, wherein said pump chamber is in continuous fluidic communication with the respective common rail and said fuel transfer circuit during each of said pumping events.

19. The fuel injection system of claim 12, further including a pressure energy recuperation means for utilizing the pressure of the fuel in said first and said second common rails as a result of the energy stored in the fuel due to the elastic compressibility of the fuel following each pumping event to assist in retraction of said pump plunger.

20. The fuel injection system of claim 19, wherein each of the injectors of said first and said second sets of fuel injectors includes an injector body containing an injector cavity, a fuel transfer circuit, an injection orifice formed in one end of said injector body, a plunger means reciprocally mounted in said injector cavity for pressurizing injection fuel and a high pressure chamber formed in said injector cavity between said plunger means and said injection orifice, wherein said pressure energy recuperation means further utilizes the pressure of the fuel in said high pressure chamber of at least one injector to assist in retraction of said high pressure plunger during each pumping event.

21. The fuel injection system of claim 20, wherein said pressure energy recuperation means utilizes the pressure of the fuel in said high pressure chambers of all injectors of one of said first set and said second set of injectors to assist in the retraction of said high pressure plunger during each pumping event.

22. A fuel injection system for controlling fuel injection into combustion chambers of a multi-cylinder internal combustion engine, comprising:

a fuel supply means including a low pressure fuel supply for supplying fuel at a low supply pressure and a first common rail fluidically connected to said low pressure fuel supply;

a first high pressure pump for receiving low pressure supply fuel from said low pressure fuel supply means and cyclically increasing and decreasing the fuel pressure in said first common rail to create pumping events, each of said pumping events including a period of increasing fuel pressure followed by a period of decreasing fuel pressure; and a first set of fuel injectors connected to said first common rail for receiving fuel from said first common rail and for injecting fuel at high pressure into respective combustion chambers of the engine, each injector of said first set of injectors including an injector body containing an injector cavity, a fuel transfer circuit and an injection orifice formed in one end of said injector body and further including a plunger means reciprocably mounted in said injector cavity, wherein each of said plunger means associated with each of said first set of injectors reciprocates during each of said pumping events in response to increasing and decreasing fuel pressure.

23. The fuel injection system of claim 22, further including a second common rail fluidically connectable to said low pressure fuel supply, a second high pressure pump for receiving low pressure supply fuel from said low pressure fuel supply means and cyclically increasing and decreasing the fuel pressure in said second common rail to create sequential pumping events, each of said pumping events including a period of increasing fuel pressure followed by a period of decreasing fuel pressure, and a second set of fuel injectors connected to said second common rail for receiving fuel from said second common rail and for injecting fuel at high pressure into respective combustion chambers of the engine, each injector of said second set of injectors including an injector body containing an injector cavity, a fuel transfer circuit and an injection orifice formed in one end of said injector body and further including a plunger means reciprocably mounted in said injector cavity, wherein each of said plunger means associated with each of said second set of injectors reciprocates during each of said pumping events in response to increasing and decreasing fuel pressure.

24. The fuel injection system of claim 23, wherein each injector of said first and said second sets of fuel injectors includes a closed nozzle assembly mounted in said injector cavity, said closed nozzle assembly including a needle valve element reciprocably mounted for movement between a closed position blocking fuel flow through said injection orifice and an open position permitting fuel flow through said injection orifice, each injector of said first and said second sets of injectors further including a needle valve control means for moving said needle valve element between said open and said closed positions.

25. The fuel injection system of claim 24, wherein said needle valve control means includes a control volume positioned adjacent an outer end of said needle valve element, a drain circuit for draining fuel from said control volume to a low pressure drain, and an injection control valve positioned along said drain circuit for controlling the flow of fuel through said drain circuit so as to cause the movement of said needle valve element between said open and said closed positions.

26. The fuel injection system of claim 25, wherein said needle valve control means further includes a control volume charge circuit for supplying fuel from said fuel transfer circuit to said control volume, each of said first and said second sets of fuel injectors further including a flow limiting means for limiting the fuel flow from said control volume to drain when said needle valve element is in said open position, said flow limiting means including a control volume inlet port fluidically connecting said charge circuit and said control volume, a control volume outlet port fluidically connecting said control volume and said drain circuit and a flow limiting valve formed on said outer end of said needle valve element for at least partially blocking said control volume inlet port and said control volume outlet port to limit fuel flow to the low pressure drain.

27. The fuel injection system of claim 22, wherein said plunger means of each of the injectors of said first and said second sets of fuel injectors includes a fuel pressure intensification means for pressurizing injection fuel, said fuel pressure intensification means including an actuating plunger and a high pressure plunger reciprocally mounted in said injector cavity, an actuating chamber formed in said injector cavity for receiving fuel from a respective one of said first and said second common rails and a high pressure chamber formed in said injector cavity between said high pressure plunger and said injector orifice, said actuating plunger including an actuating plunger cross sectional area exposed to the fuel in said actuating chamber and said high pressure plunger having a high pressure plunger cross sectional area exposed to fuel in said high pressure chamber, said actuating plunger cross sectional area being greater than said high pressure plunger cross sectional area, said actuating plunger movable in response to the pressure of fuel in said respective common rail to cause movement of said high pressure plunger for pressurizing fuel in said high pressure chamber to a pressure level greater than said actuating fluid pressure level.

28. The fuel injection system of claim 27, wherein said fuel transfer circuit includes a delivery passage formed in said actuating plunger and said high pressure plunger for delivering fuel from said actuating chamber to said high pressure chamber.

29. A fuel injection system for controlling fuel injection into combustion chambers of a multi-cylinder internal combustion engine, comprising:

a fuel supply means including a low pressure fuel supply for supplying fuel at a low supply pressure and a first common rail fluidically connected to said low pressure fuel supply;

a first high pressure pump for receiving low pressure supply fuel from said low pressure fuel supply means and cyclically increasing and decreasing the fuel pressure in said first common rail to create pumping events, each of said pumping events including a period of increasing fuel pressure followed by a period of decreasing fuel pressure, said first high pressure pumps including a pump plunger mounted for reciprocal movement and a pump chamber formed adjacent a first end of said pump plunger;

a first set of fuel injectors connected to said first common rail for receiving fuel from said first common rail and for injecting fuel at high pressure into respective combustion chambers of the engine to define respective injection events; and a pressure energy recuperation means for utilizing the pressure of the fuel in said first common rail as a result of the energy stored in the fuel due to the elastic compressibility of the fuel to assist in retraction of said pump plunger during each pumping event.

30. The fuel injection system of claim 29, wherein each injector of said first set of injectors includes an injector body containing an injector cavity, a fuel transfer circuit, an injection orifice formed in one end of said injector body, a plunger means reciprocably mounted in said injector cavity for pressurizing injection fuel and a high pressure chamber formed in said injector cavity between said plunger means and said injection orifice, wherein said pressure energy recuperation means further utilizes the pressure of the fuel in said high pressure chamber of at least one injector to assist in retraction of said pump plunger during each pumping event.

31. The fuel injection system of claim 30, wherein said pressure energy recuperation means utilizes the pressure of the fuel in said high pressure chambers of all injectors of said first set of injectors to assist in retraction of said pump plunger during each pumping event.

32. The fuel injection system of claim 29, further including a second common rail fluidically connectable to said low pressure fuel supply, a second high pressure pump for receiving low pressure supply fuel from said low pressure fuel supply means and cyclically increasing and decreasing the fuel pressure in said second common rail to create sequential pumping events, each of said pumping events including a period of increasing fuel pressure followed by a period of decreasing fuel pressure, and a second set of fuel injectors connected to said second common rail for receiving fuel from said second common rail and for injecting fuel at high pressure into respective combustion chambers of the engine to define respective injection events, each injector of said second set of injectors including an injector body containing an injector cavity, a fuel transfer circuit, an injection orifice formed in one end of said injector body, a plunger means reciprocably mounted in said injector cavity for pressurizing injection fuel and a high pressure chamber formed in said injector cavity between said plunger means and said injection orifice, wherein said pressure energy recuperation means further utilizes the pressure of the fuel in said high pressure chamber of at least one injector during each pumping event of each of said first and said second high pressure pumps to assist in retraction of said respective pump plunger.

33. The fuel injection system of claim 32, wherein said pressure energy recuperation means utilizes the pressure of the fuel in said high pressure chambers of all injectors of one of said first set and said second set of injectors during each pumping event to assist in retraction of said respective pump plunger.

34. The fuel injection system of claim 29, wherein each injector of said first and said second sets of fuel injectors includes a closed nozzle assembly mounted in said injector cavity, said closed nozzle assembly including a needle valve element reciprocably mounted for movement between a closed position blocking fuel flow through said injection orifice and an open position permitting fuel flow through said injection orifice, each injector of said first and said second sets of injectors further including a needle valve control means for moving said needle valve element between said open and said closed positions.

35. The fuel injection system of claim 34, wherein said needle valve control means includes a control volume positioned adjacent an outer end of said needle valve element, a drain circuit for draining fuel from said control volume to a low pressure drain, and an injection control valve positioned along said drain circuit for controlling the flow of fuel through said drain circuit so as to cause the movement of said needle valve element between said open and said closed positions.

36. The fuel injection system of claim 35, wherein said needle valve control means further includes a control volume charge circuit for supplying fuel from said fuel transfer circuit to said control volume, each of said first and said second sets of fuel injectors further including a flow limiting means for limiting the fuel flow from said control volume to drain when said needle valve element is in said open position, said flow limiting means including a charge circuit outlet port opening into said control volume, a drain circuit inlet port opening into said control volume and a flow limiting valve formed on said outer end of said needle valve element for at least partially blocking said supply circuit outlet port and said drain circuit inlet port to limit fuel flow to the low pressure drain.

37. The fuel injection system of claim 29, further including a plunger position sensing means mounted in said injector cavity for detecting displacement of said plunger means.

38. The fuel injection system of claim 37, wherein said plunger position sensing means includes a linear variable differential transformer.

39. The fuel injection system of claim 32, wherein each of said first and said second high pressure pumps includes a pump plunger mounted for reciprocal movement, a pump chamber formed adjacent a first end of said pump plunger and a pump control valve for controlling the effective displacement of said pump plunger, further including a pump housing containing said first and second high pressure pumps and a cam means positioned in said pump housing for reciprocating said pump plunger of each of said first and said second high pressure pumps, said first and said second pump plungers positioned in said pump housing on opposite sides of said cam means for reciprocating along a common axis.

40. The fuel injection system of claim 32, wherein each of said first and said second high pressure pumps includes a pump plunger mounted for reciprocal movement, a pump chamber formed adjacent a first end of said pump plunger and a pump control valve for controlling the effective displacement of said pump plunger, said pump control valve including a pump control valve element extending into said pump chamber.

41. The fuel injection system of claim 40, wherein said pump chamber is in continuous fluidic communication with the respective common rail and said fuel transfer circuit during each of said pumping events.

42. A fuel injection system for controlling fuel injection into combustion chambers of a multi-cylinder internal combustion engine, comprising:

a fuel supply means including a low pressure fuel supply for supplying fuel at a low supply pressure and a common rail fluidically connected to said low pressure fuel supply;

a high pressure pump for receiving low pressure supply fuel from said low pressure fuel supply means and cyclically increasing and decreasing the fuel pressure in said common rail to create pumping events, each of said pumping events including a period of increasing fuel pressure followed by a period of decreasing fuel pressure; and a plurality of fuel injectors connected to said common rail for receiving fuel from said common rail and for injecting fuel at high pressure into respective combustion chambers of the engine, each injector of said plurality of injectors including an injector body containing an injector cavity, a fuel transfer circuit, an injection orifice formed in one end of said injector body, a plunger means reciprocably mounted in said injector cavity and an actuating chamber formed between said plunger means and said common rail, each of said actuating chambers fluidically communicating with said common rail during each of said pumping events.

43. The fuel injection system of claim 42, wherein each injector of said plurality of fuel injectors includes a closed nozzle assembly mounted in said injector cavity, said closed nozzle assembly including a needle valve element reciprocably mounted for movement between a closed position blocking fuel flow through said injection orifice and an open position permitting fuel flow through said injection orifice, each injector of said plurality of injectors further including a needle valve control means for moving said needle valve element between said open and said closed positions.

44. The fuel injection system of claim 43, wherein said needle valve control means includes a control volume positioned adjacent an outer end of said needle valve element, a drain circuit for draining fuel from said control volume to a low pressure drain, and an injection control valve positioned along said drain circuit for controlling the flow of fuel through said drain circuit so as to cause the movement of said needle valve element between said open and said closed positions.

45. The fuel injection system of claim 44, wherein said needle valve control means further includes a control volume charge circuit for supplying fuel from said fuel transfer circuit to said control volume, each of said plurality of fuel injectors further including a flow limiting means for limiting the fuel flow from said control volume to drain when said needle valve element is in said open position, said flow limiting means including a control volume inlet port fluidically connecting said charge circuit and said control volume, a control volume outlet port fluidically connecting said control volume and said drain circuit and a flow limiting valve formed on said outer end of said needle valve element for at least partially blocking said control volume inlet port and said control volume outlet port to limit fuel flow to the low pressure drain.

46. A fuel injection system for controlling fuel injection into combustion chambers of a multi-cylinder internal combustion engine, comprising:

a fuel supply means including a low pressure fuel supply for supplying fuel at a low supply pressure and a first common rail fluidically connected to said low pressure fuel supply;

a first high pressure pump for receiving low pressure supply fuel from said low pressure fuel supply means and cyclically increasing and decreasing the fuel pressure in said first common rail to create sequential pumping events, said first high pressure pump including a pump plunger mounted for reciprocal movement and a pump chamber formed adjacent a first end of said pump plunger; and a first set of fuel injectors connected to said first common rail for receiving fuel from said first common rail and for injecting fuel at high pressure into respective combustion chambers of the engine, each injector of said first set of injectors including an injector body containing an injector cavity, a fuel transfer circuit and an injection orifice formed in one end of said injector body, said pump chamber being in continuous fluidic communication with said common rail and said fuel transfer circuit during each of said pumping events.

47. The fuel injection system of claim 46, further including a second common rail fluidically connectable to said low pressure fuel supply, a second high pressure pump for receiving low pressure supply fuel from said low pressure fuel supply means and cyclically increasing and decreasing the fuel pressure in said second common rail to create sequential pumping events, each of said pumping events including a period of increasing fuel pressure followed by a period of decreasing fuel pressure, said second high pressure pump including a pump plunger mounted for reciprocal movement and a pump chamber formed adjacent a first end of said pump plunger, further including a second set of fuel injectors connected to said second common rail for receiving fuel from said second common rail and for injecting fuel at high pressure into respective combustion chambers of the engine, each injector of said second set of injectors including an injector body containing an injector cavity, a fuel transfer circuit and an injection orifice formed in one end of said injector body, said pump chamber of said second high pressure pump being in continuous fluidic communication with said second common rail and said fuel transfer circuit during each of said pumping events.

48. The fuel injection system of claim 47, wherein each injector of said first and said second sets of fuel injectors includes a closed nozzle assembly mounted in said injector cavity, said closed nozzle assembly including a needle valve element reciprocably mounted for movement between a closed position blocking fuel flow through said injection orifice and an open position permitting fuel flow through said injection orifice, each injector of said first and said second sets of injectors further including a needle valve control means for moving said needle valve element between said open and said closed positions.

49. The fuel injection system of claim 36, wherein said needle valve control means includes a control volume positioned adjacent an outer end of said needle valve element, a drain circuit for draining fuel from said control volume to a low pressure drain, and an injection control valve positioned along said drain circuit for controlling the flow of fuel through said drain circuit so as to cause the movement of said needle valve element between said open and said closed positions.

50. The fuel injection system of claim 49, wherein said needle valve control means further includes a control volume charge circuit for supplying fuel from said fuel transfer circuit to said control volume, each of said first and said second sets of fuel injectors further including a flow limiting means for limiting the fuel flow from said control volume to drain when said needle valve element is in said open position, said flow limiting means including a control volume inlet port fluidically connecting said charge circuit and said control volume, a control volume outlet port fluidically connecting said control volume and said drain circuit and a flow limiting valve formed on said outer end of said needle valve element for at least partially blocking said control volume inlet port and said control volume outlet port to limit fuel flow to the low pressure drain.

51. The fuel injection system of claim 48, wherein each injector of said first and said second sets of fuel injectors further including a plunger means reciprocably mounted in said injector cavity, wherein each of said plunger means includes a fuel pressure intensification means for pressurizing injection fuel, said fuel pressure intensification means including an actuating plunger and a high pressure plunger reciprocally mounted in said injector cavity, an actuating chamber formed in said injector cavity for receiving fuel from a respective one of said first and said second common rails and a high pressure chamber formed in said injector cavity between said high pressure plunger and said injector orifice, said actuating plunger including an actuating plunger cross sectional area exposed to the fuel in said actuating chamber and said high pressure plunger having a high pressure plunger cross sectional area exposed to fuel in said high pressure chamber, said actuating plunger cross sectional area being greater than said high pressure plunger cross sectional area, said actuating plunger movable in response to the pressure of fuel in said respective common rail to cause movement of said high pressure plunger for pressurizing fuel in said high pressure chamber to a pressure level greater than said actuating fluid pressure level.

52. The fuel injection system of claim 51, wherein said fuel transfer circuit includes a delivery passage formed in said actuating plunger and said high pressure plunger for delivering fuel from said actuating chamber to said high pressure chamber.

53. The fuel injection system of claim 46, further including a plunger position sensing means mounted in said injector cavity for detecting displacement of said plunger means.

54. The fuel injection system of claim 53, wherein said plunger position sensing means includes a linear variable differential transformer.

55. The fuel injection system of claim 47, wherein each of said first and said second high pressure pumps further includes a pump control valve for controlling the effective displacement of said pump plunger, said pump control valve including a pump control valve element extending into said pump chamber.

56. The fuel injection system of claim 46, wherein each of said pump chambers is in continuous fluidic communication with the respective common rail and said fuel transfer circuit of the injectors connected to the respective common rail during each respective pumping event.

57. The fuel injection system of claim 51, wherein each of said plunger means associated with each of said first and said second sets of injectors reciprocates during each of said pumping events in response to increasing and decreasing fuel pressure.

58. A fuel injection system for controlling fuel injection into combustion chambers of a multi-cylinder internal combustion engine, comprising:

a fuel supply means including a low pressure fuel supply for supplying fuel at a low supply pressure and a common rail fluidically connected to said low pressure fuel supply;

a high pressure pump for receiving low pressure supply fuel from said low pressure fuel supply means and cyclically increasing and decreasing the fuel pressure in said common rail to create pumping events, each of said pumping events including a period of increasing fuel pressure followed by a period of decreasing fuel pressure; and a plurality of fuel injectors connected to said common rail for receiving fuel from said common rail and for injecting fuel at high pressure into respective combustion chambers of the engine, each injector of said plurality of injectors including an injector body containing an injector cavity, a fuel transfer circuit and an injection orifice formed in one end of said injector body and further including a fuel pressure intensification means for pressurizing injection fuel, said fuel pressure intensification means including an actuating plunger and a high pressure plunger reciprocally mounted in said injector cavity, an actuating chamber formed in said injector cavity for receiving fuel from said common rail and a high pressure chamber formed in said injector cavity between said high pressure plunger and said injector orifice, said actuating plunger including an actuating plunger cross sectional area exposed to the fuel in said actuating chamber and said high pressure plunger having a high pressure plunger cross sectional area exposed to fuel in said metering. chamber, said actuating plunger cross sectional area being greater than said high pressure plunger cross sectional area, said actuating plunger movable in response to the pressure of fuel in said common rail to cause movement of said high pressure plunger for pressurizing fuel in said high pressure chamber to a pressure level greater than said actuating fluid pressure level, said fuel transfer circuit including a delivery passage formed in said actuating plunger and said high pressure plunger for delivering fuel from said actuating chamber to said high pressure chamber.

59. The fuel injection system of claim 58, wherein said delivery passage extends axially through said high pressure plunger and said actuating plunger and includes a first end formed in said actuating plunger and opening into said actuating chamber, and a second end formed in said high pressure plunger and opening into said high pressure chamber.

60. The fuel injection system of claim 59, wherein each injector of said plurality of fuel injectors includes a closed nozzle assembly mounted in said injector cavity, said closed nozzle assembly including a needle valve element reciprocably mounted for movement between a closed position blocking fuel flow through said injection orifice and an open position permitting fuel flow through said injection orifice, each injector of said plurality of injectors further including a needle valve control means for moving said needle valve element between said open and said closed positions.

61. The fuel injection system of claim 60, wherein said needle valve control means includes a control volume positioned adjacent an outer end of said needle valve element, a drain circuit for draining fuel from said control volume to a low pressure drain, and an injection control valve positioned along said drain circuit for controlling the flow of fuel through said drain circuit so as to cause the movement of said needle valve element between said open and said closed positions.

62. The fuel injection system of claim 61, wherein said needle valve control means further includes a control volume charge circuit for supplying fuel from said fuel transfer circuit to said control volume, each of said plurality of fuel injectors further including a flow limiting means for limiting the fuel flow from said control volume to drain when said needle valve element is in said open position, said flow limiting means including a control volume inlet port fluidically connecting said charge circuit and said control volume, a control volume outlet port fluidically connecting said control volume and said drain circuit and a flow limiting valve formed on said outer end of said needle valve element for at least partially blocking said control volume inlet port and said control volume outlet port to limit fuel flow to the low pressure drain.

63. The fuel injection system of claim 58, wherein each injector includes a needle cavity and a needle valve element positioned in said needle cavity and reciprocably mounted in said injector body for movement between a closed position blocking flow through said injector orifice and an open position permitting fuel flow through said injector orifice, wherein fuel pressure in each of said needle cavities cyclically increases and decreases during each of said pumping events.

64. A fuel injection system for controlling fuel injection into combustion chambers of a multi-cylinder internal combustion engine, comprising:

a high pressure supply means for supplying fuel at a high pressure;

one or more fuel injectors positioned to receive the high pressure fuel and including an injector body containing an injector cavity, a fuel transfer circuit, an injection orifice formed in one end of said injector body and a closed nozzle assembly mounted in said injector cavity, said closed nozzle assembly including a needle valve element reciprocably mounted for movement between a closed position blocking fuel flow through said injection orifice and an open position permitting fuel flow through said injection orifice, each of said one or more fuel injectors further including a needle valve control means for moving said needle valve element between said open and said closed positions, said needle valve control means including a control volume positioned adjacent an outer end of said needle valve element, a control volume charge circuit for supplying fuel from said fuel transfer circuit to said control volume, a drain circuit for draining fuel from said control volume to a low pressure drain, and an injection control valve positioned along said drain circuit for controlling the flow of fuel through said drain circuit so as to cause the movement of said needle valve element between said open and said closed positions, each of said one or more fuel injectors further including a flow limiting means for limiting the fuel flow from said control volume to drain when said needle valve element is in said open position, said flow limiting means including a control volume inlet port fluidically connecting said charge circuit and said control volume, a control volume outlet port fluidically connecting said control volume and said drain circuit and a flow limiting valve formed on said outer end of said needle valve element for at least partially blocking said control volume inlet port and said control volume outlet port to limit fuel flow to the low pressure drain.

65. The fuel injection system of claim 64, wherein said drain circuit includes a drain passage formed integrally in said needle valve element.

* * * * *